US008952875B2

(12) United States Patent
Hasegawa

(10) Patent No.: US 8,952,875 B2
(45) **Date of Patent: *Feb. 10, 2015**

(54) DISPLAY DEVICE AND ELECTRONIC DEVICE

(71) Applicant: Sony Corporation, Tokyo (JP)

(72) Inventor: Hiroshi Hasegawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/255,656

(22) Filed: Apr. 17, 2014

(65) Prior Publication Data

US 2014/0225939 A1 Aug. 14, 2014

Related U.S. Application Data

(63) Continuation of application No. 12/970,322, filed on Dec. 16, 2010, now Pat. No. 8,754,834.

(30) Foreign Application Priority Data

Dec. 25, 2009 (JP) ..... 2009-295331
Jan. 13, 2010 (JP) ..... 2010-005084

(51) Int. Cl.
*G09G 3/32* (2006.01)
*G09G 3/20* (2006.01)

(52) U.S. Cl.
CPC ..... *G09G 3/3225* (2013.01); *G09G 3/3283* (2013.01); *G09G 3/2074* (2013.01); (Continued)

(58) Field of Classification Search
CPC . G09G 3/3225; G09G 3/3283; G09G 3/2074; G09G 2300/0861; G09G 2320/045; G09G 2310/06; G09G 2320/0242; G09G 2300/0443
USPC ..... 345/30–111, 204–215, 690–699
See application file for complete search history.

(56) References Cited

U.S. PATENT DOCUMENTS 6,583,775 B1 6/2003 Sekiya et al.
2004/0195963 A1 10/2004 Choi et al.
(Continued)

FOREIGN PATENT DOCUMENTS

CN 1801298 A 7/2006
CN 1975846 A 6/2007
(Continued)

OTHER PUBLICATIONS

Chinese Office Action issued in connection with related Chinese patent application No. 201010604529.6 dated Apr. 2, 2014.
(Continued)

*Primary Examiner* — Michael Pervan
(74) *Attorney, Agent, or Firm* — Dentons US LLP

(57) ABSTRACT

A display device in which an emission period may be adjusted into multiple types with reduction in cost being achieved. The display device includes: a plurality of pixels, each pixel including a plurality of individual-color sub-pixels, each sub-pixel including an individual-color light emitting element and an emission control transistor; and emission control lines connected to the pixels. The individual-color sub-pixel includes one of a first individual-color sub-pixel including an emission control transistor of a first conductive type, and a second individual-color sub-pixel including an emission control transistor of a second conductive type different from the first conductive type. One emission control line is connected in common with at least one of each of the first and second individual-color sub-pixels.

18 Claims, 19 Drawing Sheets

(52) U.S. Cl.
CPC ..... *G09G2300/0443* (2013.01); *G09G 2300/0861* (2013.01); *G09G 2310/06* (2013.01); *G09G 2320/0242* (2013.01); *G09G 2320/045* (2013.01)
USPC ..... 345/82; 345/204; 345/690

(56) References Cited

U.S. PATENT DOCUMENTS

| | | | |
|---|---|---|---|
| 2005/0104817 | A1 | 5/2005 | Kwak |
| 2006/0017394 | A1 | 1/2006 | Tada et al. |
| 2006/0145964 | A1 | 7/2006 | Park et al. |
| 2006/0187155 | A1 | 8/2006 | Chang et al. |
| 2007/0126671 | A1 | 6/2007 | Naoaki |
| 2009/0289966 | A1 | 11/2009 | Ikeda et al. |

FOREIGN PATENT DOCUMENTS

| | | |
|---|---|---|
| JP | 2001-060076 | 3/2001 |
| JP | 2002-287664 | 10/2002 |
| JP | 2004-046140 | 2/2004 |
| JP | 2004-311440 | 11/2004 |
| JP | 2005-189387 | 7/2005 |
| JP | 2006-113325 | 4/2006 |
| JP | 2006-215559 | 8/2006 |
| JP | 2007-156383 | 6/2007 |
| JP | 2008-224853 | 9/2008 |

OTHER PUBLICATIONS

Japanese Office Examination Report issued in connection with related Japanese Patent Application No. JP 2009-295331 dated Oct. 14, 2014.

FIG. 4A
RELATED ART
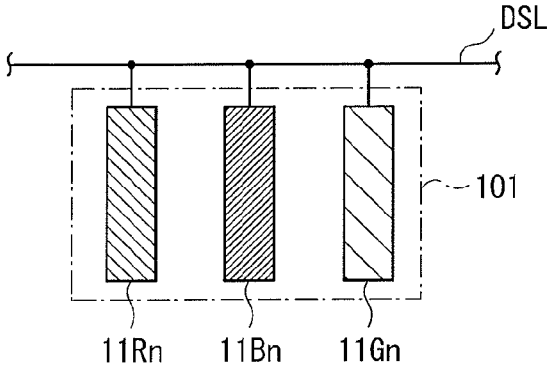
FIG. 4B
RELATED ART
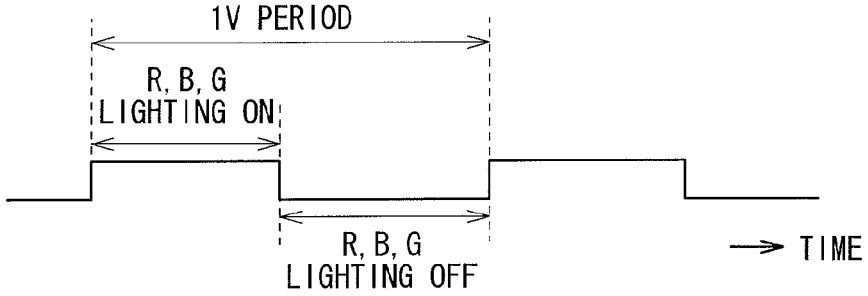
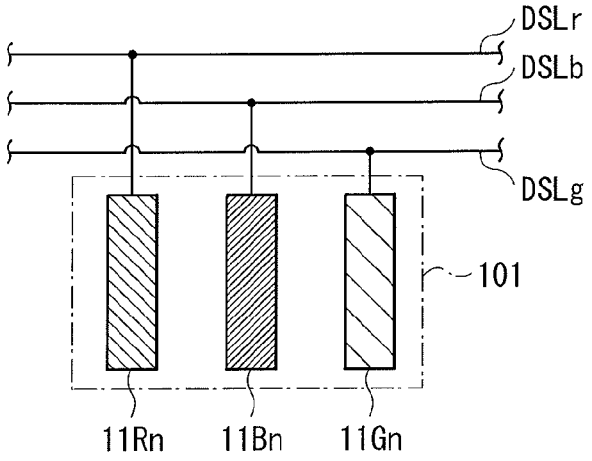
FIG. 5
RELATED ART

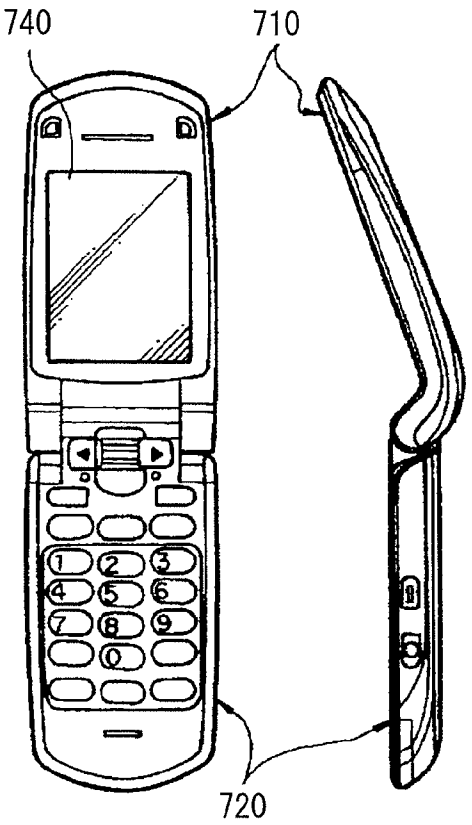
FIG. 24A
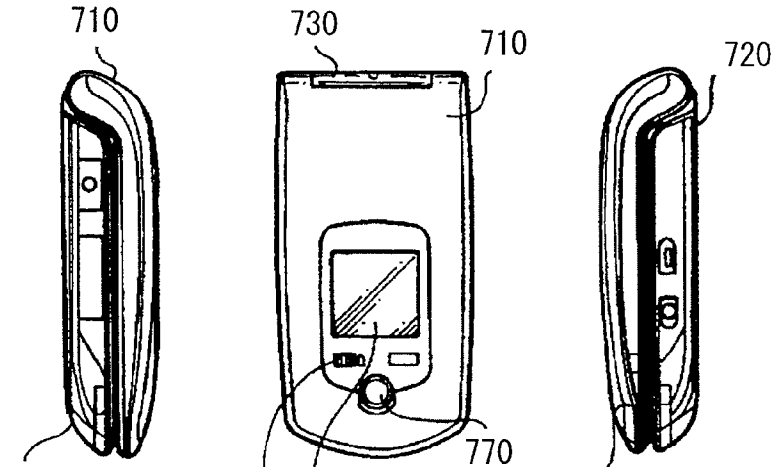
FIG. 24B
FIG. 24D
FIG. 24E
FIG. 24C
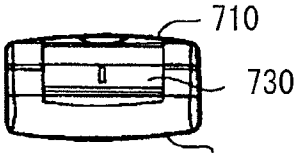
FIG. 24F
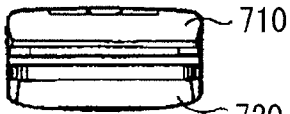
FIG. 24G

DISPLAY DEVICE AND ELECTRONIC DEVICE

RELATED APPLICATION DATA

This application is a continuation of U.S. patent application Ser. No. 12/970,322 filed Dec. 16, 2010, the entirety of which is incorporated herein by reference to the extent permitted by law. The present application claims the benefit of priority to Japanese Patent Application No. JP 2009-295331 filed on Dec. 25, 2009 and Japanese Patent Application No. JP 2010-005084 filed on Jan. 13, 2010 in the Japan Patent Office, the entirety of which are incorporated by reference herein to the extent permitted by law.

BACKGROUND OF THE INVENTION

1. Field of the Invention

The present invention relates to a display device including organic EL (Electro Luminescence) elements or the like, and an electronic device having such a display device.

2. Description of Related Art

In a field of display devices for image display, a display device using current-drive optical elements as light emitting elements, for example, a display device using organic EL elements (organic EL display device) has been recently developed and is being commercialized, the current-drive optical element being changed in emission luminance in accordance with a value of electric current flowing into the optical element.

The organic EL element is a self-luminous element unlike a liquid crystal element or the like. Therefore, the organic EL display device does not need a light source (backlight), and therefore high in image visibility, low in power consumption, and high in element response speed compared with a liquid crystal display device that needs a light source.

A drive method of the organic EL display device includes simple (passive) matrix drive and active matrix drive as in the liquid crystal display device. In the simple matrix drive, while a device structure is simplified, a large display with high resolution is inconveniently hardly achieved. Therefore, the active matrix drive is being actively developed at present. In the active matrix drive, electric current flowing into an organic EL element disposed for each pixel is controlled by an active element (typically TFT (Thin Film Transistor)) in a pixel circuit provided for each organic EL element.

In such an organic EL display device, a current-voltage (I-V) characteristic of the organic EL element degrades with the lapse of time (temporal degradation) as well known. In a pixel circuit that current-drives the organic EL element, when the I-V characteristic of the organic EL element is changed with time, a value of current flowing into a drive transistor is changed. Thus, a value of current flowing into the organic EL element is also changed, and accordingly emission luminance is changed.

In the organic EL display device, each pixel is typically configured of three sub-pixels corresponding to three primary colors, R (red), G (green) and B (blue), or four sub-pixels including a sub-pixel corresponding to a color of W (white) in addition to the three sub-pixels. In this case, as well known, rate of the degradation of the organic EL element is different for each of individual-color sub-pixels, and thus temporal color shift occurs in each pixel, leading to reduction in display image quality.

A reason for such difference in degradation for each of individual-color sub-pixels mainly includes a fact that a characteristic (luminous efficiency) of a luminescent material of an organic EL element is different for each of colors. As another reason, density of current (current density) flowing into the organic EL element is different for each of individual-color sub-pixels to adjust white balance. This is because current density needs to be set high in a sub-pixel corresponding to a color, where luminous efficiency of the organic EL element is relatively low, compared with in sub-pixels of other colors, leading to increase in degradation rate of the relevant sub-pixel.

Thus, for example, the following two methods are proposed to suppress temporal color shift caused by the latter reason (difference in current density). In the first method, an aperture ratio is varied for each of individual-color sub-pixels, thereby while current density is not varied for each of colors unlike the above, degradation rate is equalized between colors (for example, see Japanese Unexamined Patent Application Publication No. 2006-215559). In the second method, a plurality of sub-pixels are provided for one color in each pixel, thereby while current density is not varied for each of colors, degradation rate is equalized between colors as in the first method (for example, see Japanese Unexamined Patent Application Publication No. 2004-311440).

SUMMARY OF THE INVENTION

However, in the first method, for example, when the organic EL element is formed by evaporation with a shadow mask, various shadow masks are necessary in correspondence to individual colors to vary an aperture ratio for each of colors. Therefore, the number of manufacturing steps is increased compared with a case where the aperture ratio is constant between colors (the same kind of shadow mask is used for individual colors), causing increase in cost.

In the second method, for example, when a white line having a width corresponding to width of a pixel is displayed, a high resolution image may be blurred in color or may appear unevenly due to the multiple sub-pixels for one color. That is, display image quality may be reduced in the second method.

Thus, a method of equalizing degradation rate between colors has been proposed, in which a structure (an aperture ratio or number) of a sub-pixel is not varied for each of colors, and current density is also not varied for each of colors unlike in the two methods. Specifically, length of an emission period is adjusted for each of individual-color sub-pixels so as to equalize degradation rate between colors (for example, see Japanese Unexamined Patent Application Publication Nos. 2001-60076, 2007-156383, and 2008-224853).

However, in the case of using the method, control lines for adjusting an emission period need to be individually provided for each of individual-color sub-pixels. Thus, many control lines are wired for each of colors, causing increase in defective products due to reduction in aperture ratio or decrease in clearance between lines, and consequently total cost reduction is difficult to be achieved.

In some cases, timing of an emission period is requested to be adjusted in correspondence to, for example, a position of a horizontal line (H line) on a display screen instead of a color of a sub-pixel as described hereinbefore. For example, timing of an emission period is varied between an odd line and an even line to form odd and even field images, respectively.

Even in such a case, since control lines for adjusting an emission period need to be individually provided for each of odd and even lines in the previous method, total cost reduction is difficult to be achieved due to the same reason as above.

Thus, in the previous method, an emission period (specifically, length or timing of an emission period) is hard to be adjusted into multiple types with cost being reduced, and therefore further improvement has been necessary. The difficulties described hereinbefore may occur not only in the organic EL display device but also in display devices using other types of self-luminous elements.

It is desirable to provide a display device, in which an emission period may be adjusted into multiple types with reduction in cost being achieved, and provide an electronic device using the display device.

A display device of an embodiment of the invention includes a plurality of pixels, each pixel including a plurality of individual-color sub-pixels, each sub-pixel including an individual-color light emitting element and an emission control transistor, emission control lines connected to the pixels, and an emission-control-line drive circuit applying control pulses to the emission control lines for controlling an on/off state of the emission control transistor to control emission operation and non-emission operation of the individual-color light emitting element. The individual-color sub-pixel includes one of a first individual-color sub-pixel including an emission control transistor of a first conductive type and a second individual-color sub-pixel including an emission control transistor of a second conductive type different from the first conductive type. One emission control line is connected in common with at least one of each of the first and second individual-color sub-pixels.

A display device according to another embodiment of the invention includes a plurality of pixels, a plurality of emission control lines connected to the pixels, and an emission-control-line drive circuit. Each pixel includes a plurality of individual-color sub-pixels, each sub-pixel including an individual-color light emitting element. The emission-control-line drive circuit applies control pulses to the emission control lines for controlling emission operation and non-emission operation of the individual-color light emitting element. In each pixel, one emission control line among the plurality of emission control lines is assigned and connected to each of the plurality of individual-color sub-pixels, and at least one of the emission control lines is connected in common to at least two individual-color sub pixels as a part of the plurality of individual-color sub-pixels.

An electronic device according to an embodiment of the invention includes the above-mentioned display device according to the embodiment of the invention.

In the display device and the electronic device according to the embodiments of the invention, control pulses are applied to the emission control lines connected to the pixels, thereby an on/off state of the emission control transistor is controlled, so that emission operation and non-emission operation of the individual-color light emitting element are controlled. In addition, the individual-color sub-pixel is configured of one of the first individual-color sub-pixel including the emission control transistor of the first conductive type and the second individual-color sub-pixel including the emission control transistor of the second conductive type different from the first conductive type. Thus, the emission control lines may be used to adjust an emission period (length or timing of an emission period) of the individual-color sub-pixel into multiple (two) types. Furthermore, one emission control line is connected in common with at least one of each of the first and second individual-color sub-pixels, thereby a small number of emission control lines are used compared with a previous case where emission control lines are individually connected to a plurality of individual-color sub-pixels.

In another display device and another electronic device according to the embodiments of the invention, control pulses are applied to a plurality of emission control lines connected to the pixels, thereby emission operation and non-emission operation of the individual-color light emitting element are controlled. In each pixel, one emission control line among the plurality of emission control lines is assigned and connected to the plurality of individual-color sub-pixels. Thus, the plurality of emission control lines may be used to adjust an emission period of the individual-color sub-pixel into at least two types while a structure (for example, an aperture ratio or number) of an individual-color sub-pixel and current density therein are not varied for each of colors. That is, while a structure of an individual-color sub-pixel or current density therein is constant between colors, temporal color shift caused by difference in degradation rate for each of colors may be suppressed. Furthermore, at least one of the plurality of emission control lines is connected in common to at least two individual-color sub-pixels as a part of the plurality of individual-color sub-pixels, thereby a small number of emission control lines are used compared with the previous case where emission control lines are individually connected to a plurality of individual-color sub-pixels.

According to the display device and the electronic device of the embodiments of the invention, a small number of emission control lines are used compared with in the past. Accordingly, an emission period may be adjusted into multiple types with reduction in cost being achieved.

Other and further objects, features and advantages of the invention will appear more fully from the following description.

BRIEF DESCRIPTION OF THE DRAWINGS

FIGS. 4A and 4B are diagrams, each showing each sub-pixel structure and a connection structure of an emission control line to a sub-pixel in a pixel, and control pulses applied to the emission control line, according to comparative example 1.

FIG. 5 is a diagram showing each sub-pixel structure and a connection structure of an emission control line to the sub-pixel structure in a pixel according to comparative example 2.

FIG. 21A shows appearance of application example 2 as viewed from a surface side, and FIG. 21B shows appearance thereof as viewed from a back side.

FIGS. 24A to 24G are diagrams of application example 5, where FIG. 24A is a front diagram of the application example 5 in an opened state, FIG. 24B is a side diagram thereof, FIG. 24C is a front diagram thereof in a closed state, FIG. 24D is a left side diagram thereof, FIG. 24E is a right side diagram thereof, FIG. 24F is a top diagram thereof, and FIG. 24G is a bottom diagram thereof.

DETAILED DESCRIPTION OF THE PREFERRED EMBODIMENTS

Hereinafter, embodiments of the invention will be described in detail with reference to drawings. Description is made in the following sequence.

1. First embodiment (emission control line is shared by sub-pixels: sub-pixel structure of RGB)
2. Modifications of first embodiment Modification 1 (emission control line is shared by sub-pixels: sub-pixel structure of RGBW)

Modification 2 (emission control line is shared by horizontal lines)

Modification 3 (emission control line is shared by both sub-pixels and horizontal lines)

3. Second embodiment (example of case where each pixel has sub-pixel structure of RGB)
4. Modifications of second embodiment (modifications 1 to 4: examples of case where each pixel has sub-pixel structure of RGBW)
5. Module and application examples

1. First Embodiment

Configuration of Display Device

Figure 1:
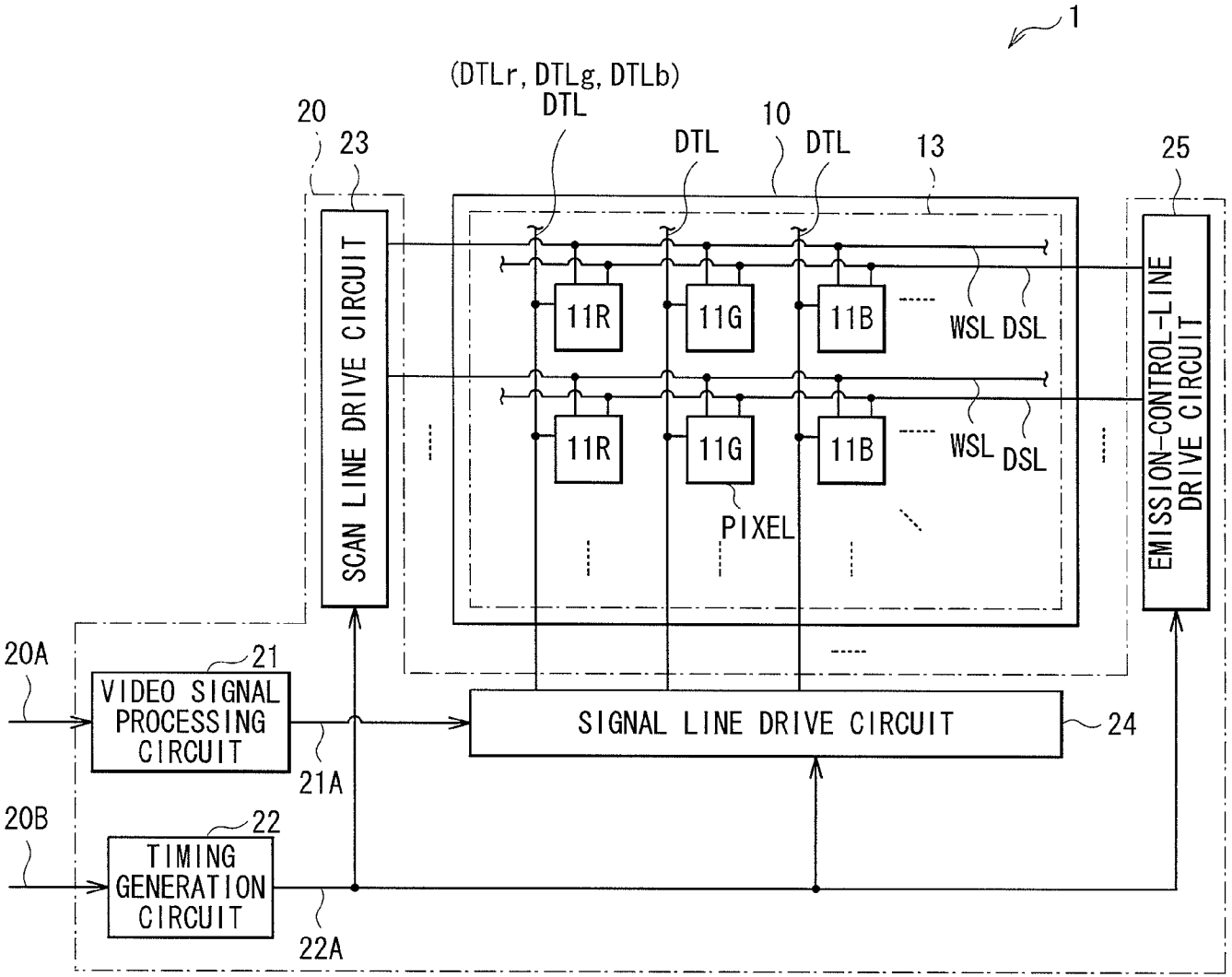
FIG. 1 is a block diagram showing an example of a display device according to first embodiment of the invention.

FIG. 1 shows a block diagram showing a schematic configuration of a display device 1 according to first embodiment of the invention. The display device 1 has a display panel 10 (display section) and a drive circuit 20.

(Display Panel 10)

The display panel 10 has a pixel array section 13 having a plurality of pixels 11 arranged in a matrix therein to perform image display by active matrix drive based on a video signal 20A and a synchronizing signal 20B received from the outside. Each pixel 11 includes a plurality of sub-pixels corresponding to a plurality of colors (individual-color sub-pixels) as will be described later.

The pixel array section 13 has a plurality of scan lines WSL arranged in rows, a plurality of signal lines DTL arranged in columns, and a plurality of emission control lines DSL arranged in rows along the scan lines WSL. One end side of each of the scan lines WSL, the signal lines DTL and the emission control lines DSL is connected to the drive circuit 20 described later. The pixels 11 are arranged in a matrix (matrix arrangement) in correspondence to intersections between the scan lines WSL and the signal lines DTL. In FIG. 1, a plurality of signal lines (signal lines for individual colors) DTLr, DTLg and DTLb corresponding to a plurality of colors as described below are shown as one signal line DTL in a simplified manner.

Figure 2A:
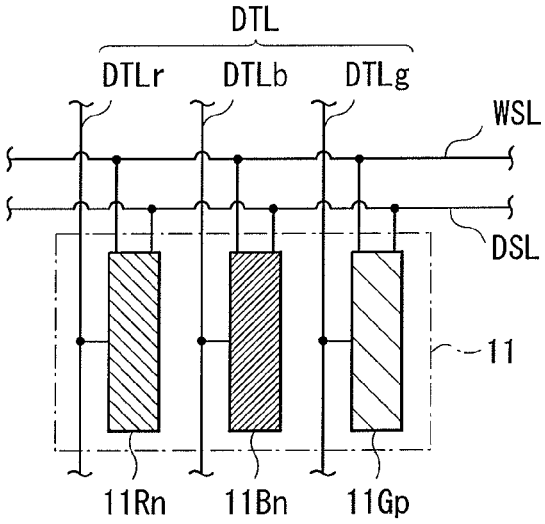
FIGS. 2A to 2C are schematic diagrams, each showing an example of a sub-pixel structure and a connection structure of each wiring line to a sub-pixel in each pixel shown in FIG. 1.
Figure 2B:
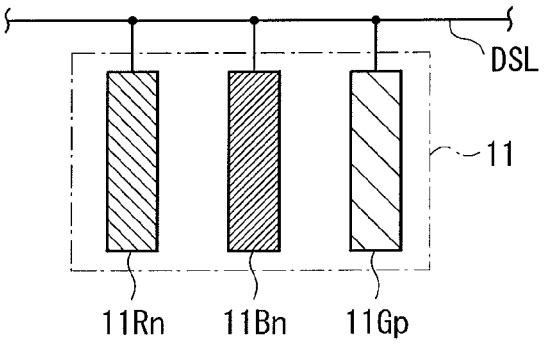
Figure 2C:
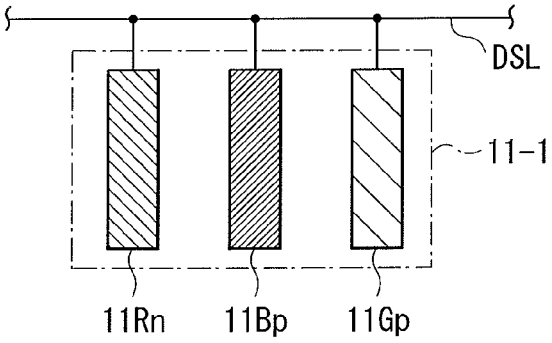

FIGS. 2A to 2C schematically show an internal configuration of each pixel 11 together with the lines.

Each pixel 11 is configured of three sub-pixels 11Rn, 11Bn and 11Gp corresponding to three primary colors of red (R), blue (B) and green (G), for example, as shown in FIG. 2A. Among them, in the sub-pixel 11Rn or 11Bn, an emission control transistor (emission control transistor Tr3*n*) described later is configured of an n-channel (first conductive type, n-type) transistor (using electrons as carriers). In the sub-pixel 11Gp, an emission control transistor (emission control transistor Tr3*p*) described later is configured of a p-channel (second conductive type, p-type) transistor (using holes as carriers). That is, each sub-pixel in the pixel array section 13 is configured of one of a sub-pixel (first individual-color sub-pixel) including the n-channel emission control transistor and a sub-pixel (second individual-color sub-pixel) including the p-channel emission control transistor. In each sub-pixel, a symbol "n" denotes the sub-pixel including the n-channel emission control transistor, and a symbol "p" denotes the sub-pixel including the p-channel emission control transistor.

Here, the sub-pixel 11Rn is connected with the signal line DTLr, the scan line WSL and the emission control line DSL. The sub-pixel 11Bn is connected with the signal line DTLb, the scan line WSL and the emission control line DSL. The sub-pixel 11Gp is connected with the signal line DTLg, the scan line WSL and the emission control line DSL. That is, the sub-pixels 11Rn, 11Bn and 11Gp are individually connected with the signal lines DTLr, DTLb and DTLg corresponding to the individual colors, but connected in common with the scan line WSL and the emission control line DSL. In other words, one emission control line DSL is connected in common with at least one of the sub-pixels (11Rn and 11Bn) including the n-channel emission control transistors and at least one sub-pixel (11Gp) including the p-channel emission control transistor.

FIG. 2B shows a wiring structure shown in FIG. 2A in a simplified manner, showing only the emission control line DSL among the signal line DTL, the scan line WSL and the emission control line DSL for convenience. In figures of similar wiring structures as shown below, a wiring structure is shown in a simplified manner (only the emission control line DSL is shown) as in FIG. 2B, and other wiring lines (the signal line DTL and the scan line WSL) are basically structured in the same way as in FIG. 2A.

A combination of n-channel and p-channel emission control transistors in a sub-pixel structure in each pixel 11 is not limited to that as shown in FIGS. 2A and 2B, and other combinations may be used. That is, for example, as a pixel 11-1 shown in FIG. 2C, it is acceptable that a sub-pixel 11Rn includes an n-channel emission control transistor, and sub-pixels 11Bp and 11Gp include p-channel emission control transistors, respectively. However, hereinafter, the embodiment is basically typically described with the pixel 11 shown in FIGS. 2A and 2B for convenience of description.

However, for example, emission control transistors with the same type of channel (n-channel or p-channel) are desirably used in sub-pixels having organic EL elements having relatively similar values of luminous efficiency among organic EL elements emitting respective color light (organic EL elements 12R, 12G and 12B) as described later. Specifically, for example, emission control transistors with the same type of channel are used in a sub-pixel 11R corresponding to red and a sub-pixel 11G corresponding to green, and an emission control transistor with another type of channel is singly used in a sub-pixel 11B corresponding to blue. Thus, when an emission period is controlled for each of sub-pixels 11R, 11G and 11B, effective control may be performed in correspondence to magnitude of luminous efficiency as described later.

Alternatively, for example, emission control transistors with the same type of channel (n-channel or p-channel) are desirably used in sub-pixels having relatively similar values of luminosity factors (visibility) specific to respective colors of R, G and B. Specifically, even in this case, for example, emission control transistors with the same type of channel are used in a sub-pixel 11R corresponding to red and a sub-pixel 11G corresponding to green, and an emission control transistor with another type of channel is singly used in a sub-pixel 11B corresponding to blue. Thus, when an emission period is controlled in the same way as above, effective control may be performed in correspondence to magnitude of a luminosity factor (visibility).

Figure 3A:
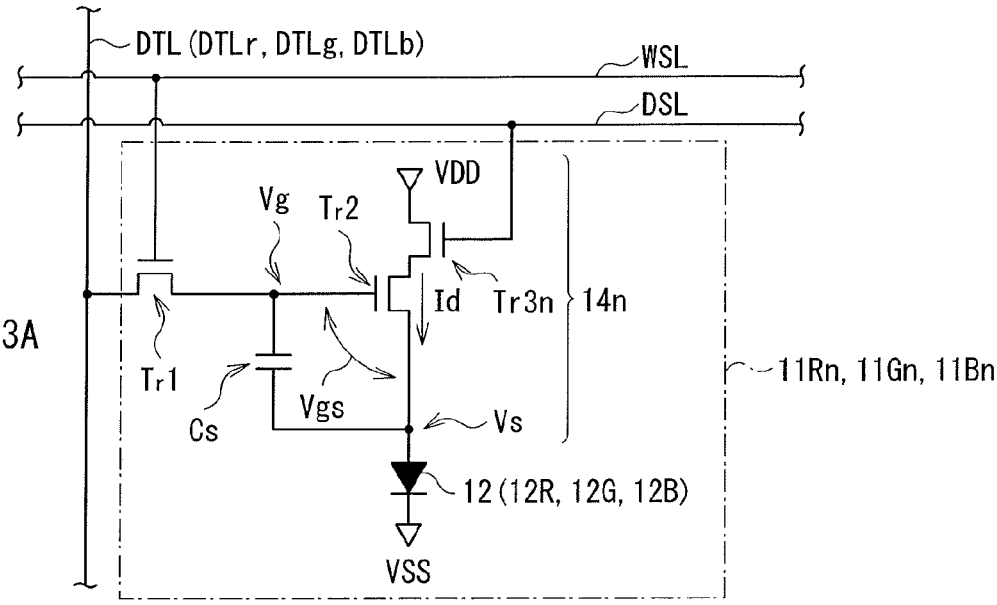
FIGS. 3A and 3B are circuit diagrams showing an example of an internal configuration of each sub-pixel shown in FIGS. 2A to 2C.
Figure 3B:
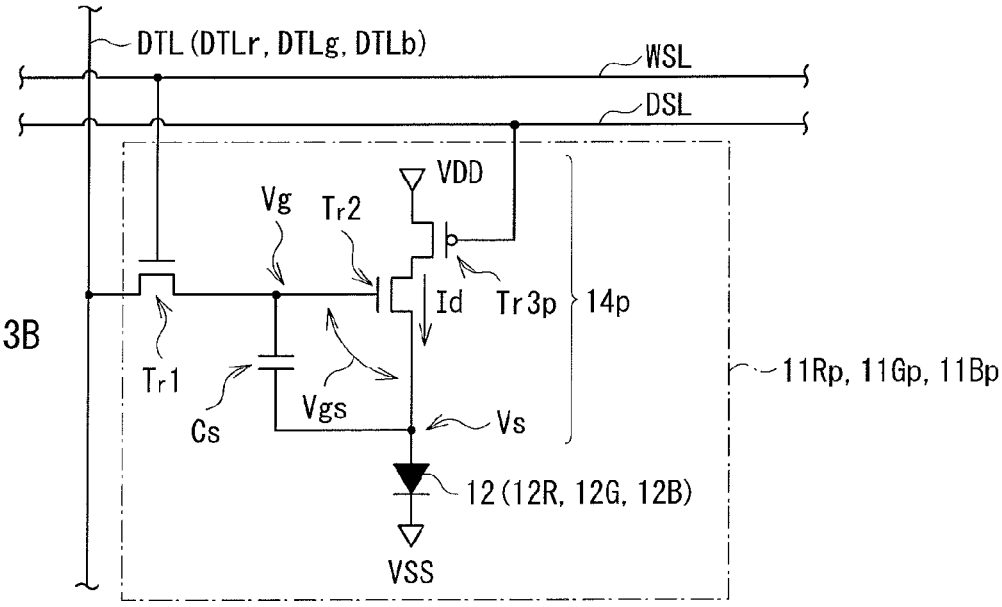

FIG. 3A shows an example of an internal configuration (circuit configuration) of a sub-pixel 11Rn, 11Gn or 11Bn including an n-channel emission control transistor. FIG. 3B shows an example of an internal configuration (circuit configuration) of a sub-pixel 11Rp, 11Gp or 11Bp including a p-channel emission control transistor.

An organic EL element 12R, 12G or 12B (individual-color light emitting element) and a pixel circuit 14*n* are provided in the sub-pixel 11Rn, 11Gn or 11Bn. An organic EL element 12R, 12G or 12B and a pixel circuit 14*p* are provided in the sub-pixel 11Rp, 11Gp or 11Bp. Hereinafter, a term, organic EL element 12, is appropriately used as a general term of the organic EL elements 12R, 12G and 12B.

As shown in FIG. 3A, the pixel circuit 14*n* includes a write (sampling) transistor Tr1 (first transistor), a drive transistor Tr2 (second transistor), an emission control transistor Tr3*n* (third transistor), and a capacitance element Cs. That is, the pixel circuit 14*n* has a circuit configuration of so-called 3Tr1C. The write transistor Tr1, the drive transistor Tr2, and the emission control transistor Tr3*n* are formed of n-channel MOS (Metal Oxide Semiconductor) TFT. A type of each transistor is not particularly limited, and, for example, may be an inversely staggered structure (so-called bottom gate type) or a staggered structure (so-called top gate type). Moreover, a circuit configuration of the pixel circuit 14*n* is not limited to the 3Tr1C, and may be any other configuration as long as an emission control circuit is provided therein.

In the pixel circuit 14*n*, a gate of the write transistor Tr1 is connected to the scan line WSL, a drain of the transistor is connected to the signal line DTL (DTLr, DTLg or DTLb), and a source thereof is connected to a gate of the drive transistor Tr2 and one end of the capacitance element Cs. A drain of the emission control transistor Tr3*n* is connected to a stationary power supply VDD, a gate of the transistor is connected to the emission control line DSL, and a source thereof is connected to a drain of the drive transistor Tr2. A source of the drive transistor Tr2 is connected to the other end of the capacitance element Cs and an anode of the organic EL element 12, and a cathode of the organic EL element 12 is set to stationary potential VSS (for example, ground potential). The cathode of the organic EL element 12 acts as a common electrode of respective organic EL elements 12, and, for example, is continuously formed as a plate-like electrode over the whole display region of the display panel 10.

As shown in FIG. 3B, the pixel circuit 14*p* includes a write transistor Tr1, a drive transistor Tr2, an emission control transistor Tr3*p* (third transistor), and a capacitance element Cs. That is, the pixel circuit 14*p* also has a circuit configuration of 3Tr1C. The write transistor Tr1 and the drive transistor Tr2 are formed of n-channel MOS TFT, and the emission control transistor Tr3*p* is formed of p-channel MOS TFT. Even in this case, a type of each transistor is not particularly limited, and, for example, may be an inversely staggered structure or a staggered structure. Moreover, a circuit configuration of the pixel circuit 14*p* is not limited to the 3Tr1C, and may be any other configuration as long as an emission control circuit is provided therein.

In the pixel circuit 14*p*, a gate of the write transistor Tr1 is connected to the scan line WSL, a drain of the transistor is connected to the signal line DTL (DTLr, DTLg or DTLb), and a source thereof is connected to a gate of the drive transistor Tr2 and one end of the capacitance element Cs. A source of the emission control transistor Tr3*p* is connected to a stationary power supply VDD, a gate of the transistor is connected to the emission control line DSL, and a drain thereof is connected to a drain of the drive transistor Tr2. A source of the drive transistor Tr2 is connected to the other end of the capacitance element Cs and an anode of the organic EL element 12, and a cathode of the organic EL element 12 is set to stationary potential VSS (for example, ground potential).

(Drive Circuit 20)

The drive circuit 20 drives the pixel array section 13 (display panel 10) (performs display drive). Specifically, the drive circuit writes a video signal voltage based on the video signal 20A to each of sub-pixels 11Rn, 11Bn and 11Gp in a selected pixel 11 while sequentially selecting a plurality of pixels 11 in the pixel array section 13, and thus performs display drive of the pixels 11. As shown in FIG. 1, the drive circuit 20 has a video signal processing circuit 21, a timing generation circuit 22, a scan line drive circuit 23, a signal line drive circuit 24, and an emission-control-line drive circuit 25.

The video signal processing circuit 21 applies predetermined correction to a digital video signal 20A received from the outside, and output a corrected video signal 21A to the signal line drive circuit 24. Such predetermined correction includes, for example, gamma correction and overdrive correction.

The timing generation circuit 22 generates a control signal 22A based on a synchronizing signal 20B received from the outside and outputs the control signal 22A so that the scan line drive circuit 23, the signal line drive circuit 24, and the emission-control-line drive circuit 25 are controlled to operate in conjunction with one another.

The scan line drive circuit 23 sequentially applies selection pulses to a plurality of scan lines WSL according to (in synchronization with) the control signal 22A so as to sequentially select a plurality of pixels 11. Specifically, the scan line drive circuit 23 selectively outputs voltage Von, which is applied when the write transistor Tr1 is set to be on, and voltage Voff, which is applied when the write transistor Tr1 is set to be off, and thus generate the selection pulses. The voltage Von has a value (certain value) equal to or larger than a value of on voltage of the write transistor Tr1, and the voltage Voff has a value (certain value) smaller than a value of on voltage of the write transistor Tr1.

The signal line drive circuit 24 generates an analog video signal corresponding to the video signal 21A received from the video signal processing circuit 21 according to (in synchronization with) the control signal 22A, and applies the analog video signal to each of the signal lines DTL (DTLr, DTLg and DTLb). Specifically, the signal line drive circuit 24 individually applies analog video signal voltages for individual-colors based on the video signal 21A to the signal lines DTL (DTLr, DTLg and DTLb). Thus, a video signal is written to each of sub-pixels 11Rn, 11Bn and 11Gp in a pixel 11 selected by the scan line drive circuit 23. Writing of a video signal means that the video signal voltage is programmed into the auxiliary capacitance element Cs so as to apply a predetermined voltage between the gate and the source of the drive transistor Tr2.

The emission-control-line drive circuit 25 sequentially applies control pulses to a plurality of emission control lines DSL according to (in synchronization with) the control signal 22A so as to control an on/off state of the emission control transistor Tr3*n* or Tr3*p* in a sub-pixel 11Rn, 11Bn or 11Gp in each pixel 11. Thus, emission (lighting-on) operation and non-emission (lighting-off) operation of an organic EL element 12 in each of the sub-pixels 11Rn, 11Bn and 11Gp in each pixel 11 are controlled. In other words, width of the control pulse (pulse width) is adjusted, so that length of an emission period and length of a non-emission period of each of the sub-pixels 11Rn, 11Bn and 11Gp in each pixel 11 are controlled (control similar to PWM (Pulse Width Modulation) is performed).

Specifically, the emission-control-line drive circuit 25 selectively outputs voltage VH, which is applied when the emission control transistor Tr3*n* is set to be on, and voltage VL, which is applied when the emission control transistor Tr3*n* is set to be off so as to generate the selection pulse. In other words, the emission-control-line drive circuit 25 selectively outputs voltage VH, which is applied when the emission control transistor Tr3*p* is set to be off, and voltage VL, which is applied when the emission control transistor Tr3*p* is set to be on so as to generate the selection pulse. The voltage VH has a value (certain value) equal to or larger than a value of on voltage of the emission control transistor Tr3*n* (voltage corresponding to an H (high) state), and has a value (certain value) smaller than a value of on voltage of the emission control transistor Tr3*p* (voltage corresponding to an L (low) state). The voltage VL has a value (certain value) smaller than a value of on voltage of the emission control transistor Tr3*n* (voltage corresponding to the L (low) state), and has a value (certain value) equal to or larger than a value of on voltage of the emission control transistor Tr3*p* (voltage corresponding to the H (high) state). Such operation of controlling an emission period of each sub-pixel 11Rn, 11Bn or 11Gp performed by the emission-control-line drive circuit 25 will be described in detail later.

Operation and Effects of Display Device

Next, operation and effects of the display device 1 of the first embodiment are described.

(Display Operation)

In the display device 1, as shown in FIGS. 1 to 3B, the drive circuit 20 performs display drive of each pixel 11 (sub-pixel 11Rn, 11Bn or 11Gp) in the display panel 10 (pixel array section 13) based on the video signal 20A and the synchronizing signal 20B. Thus, drive current is injected into an organic EL element 12 in the sub-pixel 11Rn, 11Bn or 11Gp, and thus holes are recombined with electrons, leading to light emission. As a result, the display panel 10 performs image display based on the video signal 20A.

Specifically, referring to FIGS. 2A to 2C and FIGS. 3A and 3B, writing operation of a video signal is performed in the following way in the sub-pixel 11Rn, 11Bn or 11Gp. First, during a period when voltage of the signal line DTL is a video signal voltage, and voltage of the emission control line DSL is voltage VH (H state) or voltage VL (L state), the scan line drive circuit 23 raises voltage of the scan line WSL from voltage Voff to voltage Von. Thus, the write transistor Tr1 becomes on, and therefore gate potential Vg of the drive transistor Tr2 rises to a video signal voltage corresponding to a voltage of the signal line DTL. As a result, the video signal voltage is written to the auxiliary capacitance element Cs, and held therein. In this situation, the emission control transistor Tr3*n* or the emission control transistor Tr3*p* is on. That is, the sub-pixels 11Rn and 11Bn are in a state corresponding to a case where voltage of the emission control line DSL is the voltage VH (H state), and the sub-pixel 11Gp is in a state corresponding to a case where voltage of the emission control line DSL is the voltage VL (L state).

Anode voltage of the organic EL element 12 is still lower than a voltage (Vel+Vca) as the sum of a threshold voltage Vel and cathode voltage Vca (=VSS) of the organic EL element 12, namely, the organic EL element 12 is in a cutoff state. That is, in this stage, current does not flow between the anode and the cathode of the organic EL element 12 (the organic EL element 12 does not emit light.) Therefore, current Id supplied from the drive transistor Tr2 flows into an element capacitance (not shown) existing parallel to the organic EL element 12 between the anode and the cathode of the element 12 and the element capacitance (not shown) is charged.

Next, during a period when the signal line DTL is kept at the video signal voltage and the emission control transistor keeps on, the scan line drive circuit 23 lowers voltage of the scan line WSL from the voltage Von to the voltage Voff. Thus, since the write transistor Tr1 is turned off, the gate of the drive transistor Tr2 becomes floating. Thus, current Id flows between the drain and the source of the drive transistor Tr2 while gate-to-source voltage Vgs of the transistor Tr2 is kept constant. As a result, source potential Vs of the drive transistor Tr2 rises, and gate potential Vg of the transistor Tr2 conjunctionally rises through capacitive coupling via the capacitance element Cs. Thus, the anode voltage of the organic EL element 12 becomes higher than the voltage (Vel+Vca) as the sum of the threshold voltage Vel and the cathode voltage Vca of the organic EL element 12. Accordingly, current Id flows between the anode and the cathode of the organic EL element 12, and thus the organic EL element 12 emits light with a desired luminance.

Next, the drive circuit 20 finishes the emission period of the organic EL element 12 after a predetermined period has elapsed. Specifically, the emission control line drive circuit 25 lowers voltage of the emission control line DSL from the voltage VH to the voltage VL (transfers a state of the line from the H state to the L state), or raises the voltage from the voltage VL to the voltage VH (transfers a state of the line from the L state to the H state). Thus, the emission control transistor Tr3*n* or Tr3*p* is turned off, and therefore the source potential Vs of the drive transistor Tr2 lowers. Thus, the anode voltage of the organic EL element 12 becomes lower than the voltage (Vel+Vca) as the sum of the threshold voltage Vel and the cathode voltage Vca of the organic EL element 12, and therefore current Id no longer flows between the anode and the cathode of the element 12. As a result, the organic EL element 12 does not emit light (transfers into a non-emission period) thereafter. In this way, length of an emission period of the sub-pixel 11Rn or 11Bn in each pixel 11 may be controlled in correspondence to width of each control pulse (length of a period of the H state) applied to the emission control line DSL. Similarly, length of an emission period of the sub-pixel 11Gp in each pixel 11 may be controlled in correspondence to width of each control pulse (length of a period of the L state).

After that, the drive circuit 20 performs display drive such that the emission operation and the non-emission operation described hereinbefore are periodically repeated every one frame period (one vertical period, or 1V period). Along with this, the drive circuit 20 scans control pulses applied to the emission control line DSL and selection pulses applied to the scan line WSL in a row direction, for example, every one horizontal period (1H period). In the way as above, display operation of the display device 1 (display drive by the drive circuit 20) is performed.

(Operation of Characteristic Portion)

Next, operation of a characteristic portion of the display device 1 of the embodiment will be described in detail in comparison with comparative examples (comparative examples 1 and 2).

Comparative Example 1

FIG. 4A schematically shows a structure of each of sub-pixels 11Rn, 11Bn and 11Gn and a connection structure of an emission control line DSL to the sub-pixels in a pixel 101 according to the comparative example 1. FIG. 4B shows an example of a timing waveform of control pulses applied to the emission control line DSL according to the comparative example 1.

In the comparative example 1, first, as shown in FIG. 4A, each of the three (all) sub-pixels 11Rn, 11Bn and 11Gn in a pixel 101 includes an n-channel emission control transistor Tr3*n* unlike in the first embodiment shown in FIGS. 2A to 2C. In addition, one (single) emission control line DSL is connected in common to the sub-pixels 11Rn, 11Bn and 11Gn in the pixel 101.

For example, as shown in FIG. 4B, control pulses are sequentially applied to one emission control line DSL, so that emission (lighting-on) operation and non-emission (lighting-off) operation of an organic EL element 12 in the sub-pixel 11Rn, 11Bn or 11Gn may be controlled. That is, since each of the sub-pixels 11Rn, 11Bn and 11Gn includes the n-channel emission control transistor Tr3*n* herein, an H period of a control pulse corresponds to an emission (lighting-on) period of each of the sub-pixels 11Rn, 11Bn and 11Gn as shown in the figure. An L period of the control pulse corresponds to a non-emission (lighting-off) period of the sub-pixel 11Rn, 11Bn or 11Gn.

Adjustment of width of the control pulse (pulse width) shown in the figure enables control of length of the emission period and length of the non-emission period of each of the sub-pixels 11Rn, 11Bn and 11Gn (PWM control). Specifically, a ratio of pulse width of the H period (lighting-on period) of the control pulse to pulse width of the L period (lighting-off period) thereof is controlled, thereby length (ratio) of each of the emission period and the non-emission period may be controlled within a 1V (one vertical) period.

However, the following difficulty may occur in the comparative example 1.

First, in an organic EL display device, a current-voltage (I-V) characteristic of an organic EL element typically degrades with the lapse of time (temporal degradation) as well known. In a pixel circuit that current-drives an organic EL element (for example, the pixel circuit 14*n* shown in FIG. 3A), when the I-V characteristic of the organic EL element is changed with time, a value Id of current flowing into a drive transistor (for example, the drive transistor Tr2 shown in FIG. 3A) is changed. Therefore a value of current flowing into the organic EL element itself is changed in accordance with change in the current value Id, and accordingly emission luminance is changed.

Moreover, in the organic EL display device, rate of such degradation of the organic EL element is typically different for each of individual-color sub-pixels as well known. Therefore, when the pixel 101 is configured of the sub-pixels 11Rn, 11Bn and 11Gn corresponding to three colors, for example, as in the comparative example 1, temporal color shift occurs in the pixel 101, leading to reduction in display image quality.

In this way, degradation rate is different, for example, for each of the individual-color sub-pixels 11Rn, 11Bn and 11Gn. A reason for this mainly includes a fact that luminous efficiency of an organic EL element (for example, the organic EL element 12R, 12G or 12B in FIG. 3A) is different for each of colors. As another reason, in examples of related art including the comparative example 1, density of current (current density) flowing into an organic EL element is set to be different for each of individual-color sub-pixels (for example, the sub-pixels 11Rn, 11Bn and 11Gn) in order to adjust white balance. This is because current density typically needs to be set high in a sub-pixel corresponding to a color, where luminous efficiency of the organic EL element is relatively low, compared with in sub-pixels of other colors, leading to increase in degradation rate.

Thus, for example, the following two methods are considered to suppress temporal color shift caused by such difference in current density in the comparative example 1. In the first method, an aperture ratio is varied for each of the individual-color sub-pixels 11Rn, 11Bn and 11Gn, thereby degradation rate is equalized between colors while current density is not varied for each of colors unlike the above. In the second method, a plurality of sub-pixels are provided for one color in each pixel 101, thereby degradation rate is equalized between colors while current density is not varied for each of colors as in the first method.

However, in the first method, for example, when the organic EL element 12 is formed by evaporation with a shadow mask, various shadow masks are necessary in correspondence to individual colors to vary an aperture ratio for each of colors. Therefore, the number of manufacturing steps increases compared with a case where the aperture ratio is constant between colors (the same kind of shadow mask is used for individual colors), causing increase in cost.

In the second method, for example, when a white line having a width corresponding to width of a pixel is displayed, a high resolution image may be blurred in color or may appear unevenly due to the multiple sub-pixels provided for one color. That is, display image quality is reduced in the second method.

Thus, as a method other than the methods, in the comparative example 1, width of the control pulse (FIG. 4B) is likely to be adjusted to adjust length of an emission period of each of the sub-pixels 11Rn, 11Bn and 11Gn so that degradation rate is equalized between colors. However, in the comparative example 1, one emission control line DSL is connected in common to the three sub-pixels 11Rn, 11Bn and 11Gn in the pixel 101 as described before (FIG. 4A). In addition, each of the three (all) sub-pixels 11Rn, 11Bn and 11Gn in the pixel 101 includes the n-channel emission control transistor Tr3*n*. Therefore, in the comparative example 1, the emission control line DSL may not be used to adjust length of an emission period for each of the sub-pixels 11Rn, 11Bn and 11Gn. That is, the sub-pixels 11Rn, 11Bn and 11Gn have to perform emission (lighting-on) operation or non-emission (lighting-off) operation at the same timing.

Comparative Example 2

In sub-pixels 11Rn, 11Bn and 11Gn in a pixel 101 according to the comparative example 2 shown in FIG. 5, three emission control lines DSLr, DSLb and DSLg are individually connected to the respective sub-pixels 11Rn, 11Bn and 11Gn unlike in the comparative example 1. Thus, in the comparative example 2, the three emission control lines DSLr, DSLb and DSLg may be used to adjust length of an emission period for each of the sub-pixels 11Rn, 11Bn and 11Gn so as to equalize degradation rate between colors unlike in the comparative example 1. That is, in the comparative example 2, degradation rate may be equalized between colors while a structure (an aperture ratio or number) of each sub-pixel and current density are not varied for each of colors.

However, in the comparative example 2, control lines (here, the three emission control lines DSLr, DSLb and DSLg) for adjusting an emission period need to be individually provided for each of the individual-color sub-pixels 11Rn, 11Bn and 11Gn. Thus, many emission control lines DSLr, DSLb and DSLg are wired for each of colors, causing increase in defective products due to reduction in aperture ratio of each pixel 101 or decrease in clearance between lines, consequently total cost reduction is hardly achieved.

First Embodiment

In contrast, in the display device 1 of the first embodiment, first, one emission control line DSL is connected in common to three sub-pixels in a pixel 11 as in the comparative example 1, for example, as shown in FIGS. 2B and 2C. Specifically, while one emission control line DSL is connected in common to the three sub-pixels 11Rn, 11Bn and 11Gp in the pixel 11 in FIG. 2B, one emission control line DSL is connected in common to the three sub-pixels 11Rn, 11Bp and 11Gp in the pixel 11 in FIG. 2C.

However, in the first embodiment, the three sub-pixels in the pixel 11 include both of a sub-pixel using an n-channel emission control transistor Tr3*n* and a sub-pixel using a p-channel emission control transistor Tr3*p* unlike in the comparative example 1. Specifically, for example, in FIG. 2B, the sub-pixels 11Rn and 11Bn use the n-channel emission control transistors Tr3*n*, and the sub-pixel 11Gp uses the p-channel emission control transistor Tr3*p*. For example, in FIG. 2C, the sub-pixel 11Rn uses the n-channel emission control transistor Tr3*n*, and the sub-pixels 11Bp and 11Gp use the p-channel emission control transistors Tr3*p*.

Thus, in the first embodiment, an emission period may be adjusted into multiple types (two types) in each pixel 11 by means of the sub-pixel using the n-channel emission control transistor Tr3*n* and the sub-pixel using the p-channel emission control transistor Tr3*p*. Specifically, length or timing of an emission period may be adjusted into multiple types (two types). Therefore, degradation rate may be equalized between colors while a structure (for example, an aperture ratio or number) of each sub-pixel and current density therein are not varied for each of colors as in the comparative example 2. That is, while a structure of a sub-pixel or current density therein is constant between colors, temporal color shift caused by difference in degradation rate for each of colors may be suppressed.

In the first embodiment, as described before, one emission control line DSL is connected in common to the three sub-pixels 11Rn, 11Bn and 11Gp in the pixel 11 unlike in the comparative example 2. In other words, one emission control line DSL is connected in common with both of the sub-pixels 11Rn and 11Bn and the sub-pixel 11Gp.

Thus, a small number of emission control lines are used in the first embodiment compared with the comparative example 2 where the emission control lines DSLr, DSLb and DSLg are individually connected to the three sub-pixels 11Rn, 11Bn and 11Gn. That is, in this case, while the three emission control lines DSLr, DSLb and DSLg are used in the comparative example 2, only one emission control line DSL is used in the first embodiment. Consequently, in the first embodiment, although only one emission control line DSL is shared by the sub-pixels, temporal color shift caused by difference in degradation rate for each of colors may be suppressed while a structure of a sub-pixel or current density therein is constant between colors.

In the first embodiment, the above adjustment (control) operation of an emission period of each sub-pixel using one emission control line is specifically performed as follows. While the following description of FIGS. 6 to 8B is made with the sub-pixel structure of the pixel 11 shown in FIGS. 2A and 2B as an example, the same holds true for other sub-pixel structures such as the pixel 11 shown in FIG. 2C.

Figure 6:
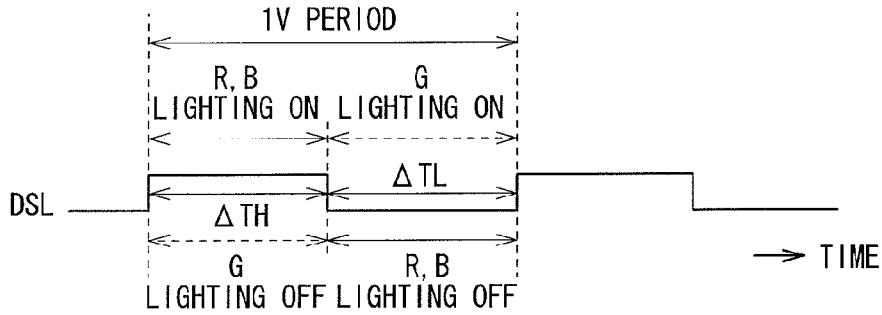
FIG. 6 is a timing waveform diagram showing an example of control pulses applied to an emission control line according to the first embodiment.

That is, for example, as shown in FIG. 6, the emission-control-line drive circuit 25 sequentially applies control pulses to one emission control line DSL to control emission (lighting-on) operation and non-emission (lighting-off) operation of the organic EL element 12 in each of the sub-pixels 11Rn, 11Bn and 11Gp.

Specifically, each of the sub-pixels 11Rn and 11Bn includes the n-channel emission control transistor Tr3*n* herein. Therefore, as shown in the figure, an H period ΔTH of a control pulse corresponds to an on period of the emission control transistor Tr3*n*, and thus corresponds to an emission (lighting-on) period of the sub-pixel 11Rn or 11Bn. An L period ΔTL of the control pulse corresponds to an off period of the emission control transistor Tr3*n*, and thus corresponds to a non-emission (lighting-off) period of the sub-pixel 11Rn or 11Bn.

On the other hand, the sub-pixel 11Gp includes the p-channel emission control transistor Tr3*p*. Therefore, as shown in the figure, an L period ΔTL of a control pulse corresponds to an on period of the emission control transistor Tr3*p*, and thus corresponds to an emission (lighting-on) period of the sub-pixel 11Gp. An H period ΔTH of the control pulse corresponds to an off period of the emission control transistor Tr3*p*, and thus corresponds to a non-emission (lighting-off) period of the sub-pixel 11Gp.

Figure 7:
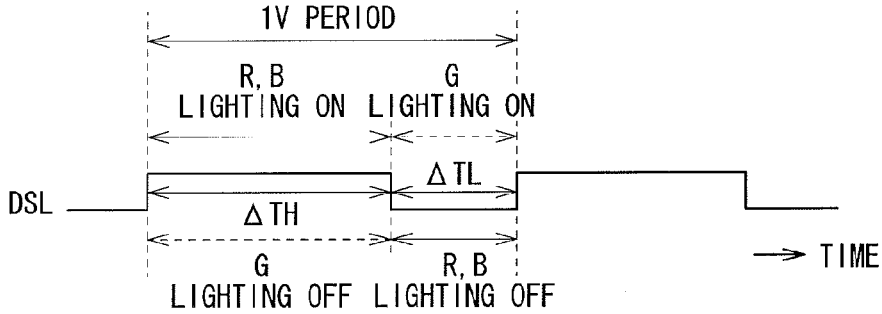
FIG. 7 is a timing waveform diagram showing another example of control pulses applied to an emission control line according to the first embodiment.

For example, as shown in FIG. 7, the emission-control-line drive circuit 25 adjusts width of each control pulse applied to the emission control line DSL, and thus controls length of the emission period and length of the non-emission period of each of the sub-pixels 11Rn, 11Bn and 11Gp (PWM control). Specifically, the emission-control-line drive circuit 25 controls a ratio of length of the H period ΔTH of a control pulse to length of the L period ΔTL thereof, thereby controls length (ratio) of each of the emission period and the non-emission period within a 1V period. More specifically, the emission-control-line drive circuit 25 controls length of the emission (lighting-on) period of each of the sub-pixels 11Rn and 11Bn and length of the non-emission (lighting-off) period of the sub-pixel 11Gp in correspondence to length of the H period ΔTH of the control pulse. In addition, the emission-control-line drive circuit 25 controls length of the non-emission (lighting-off) period of each of the sub-pixels 11Rn and 11Bn and length of the emission (lighting-on) period of the sub-pixel 11Gp in correspondence to length of the L period ΔTL of the control pulse.

The emission-control-line drive circuit 25 adjusts length of the H period ΔTH of the control pulse and length of the L period ΔTL thereof respectively such that an emission period is short in a sub-pixel corresponding to a color, where luminous efficiency of the organic EL element 12 is relatively high, compared with in a sub-pixel corresponding to a color, where luminous efficiency of the EL element 12 is relatively low. Thus, temporal color shift caused by difference in degradation rate for each of colors may be suppressed. For example, here, an emission period is short in the sub-pixel 11Gp compared with in the sub-pixels 11Rn and 11Bn.

Figure 8A:
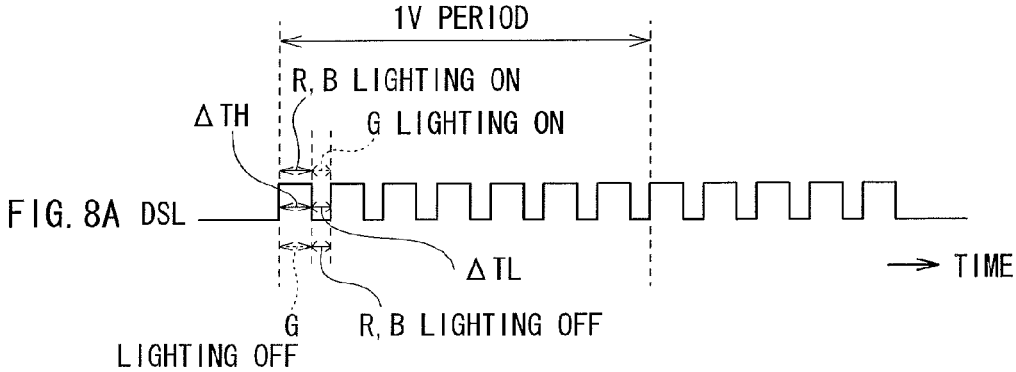
FIGS. 8A and 8B are timing waveform diagrams showing other examples of control pulses applied to an emission control line according to the first embodiment.

Furthermore, for example, as shown in FIG. 8A, the emission-control-line drive circuit 25 desirably performs the control such that a frequency component of control pulses is increased with a certain duty ratio, for example, as shown in FIG. 7 (ratio of length of the H period ΔTH of a control pulse to length of the L period ΔTL thereof) being kept. In other words, the emission-control-line drive circuit 25 desirably controls frequency of control pulses such that a control pulse has a plurality of H periods ΔTH and a plurality of L periods ΔTL within a 1V period. Thus, a residual color (coloring or color breaking) is reduced in the periphery of an image in moving image display or the like.

Figure 8B:
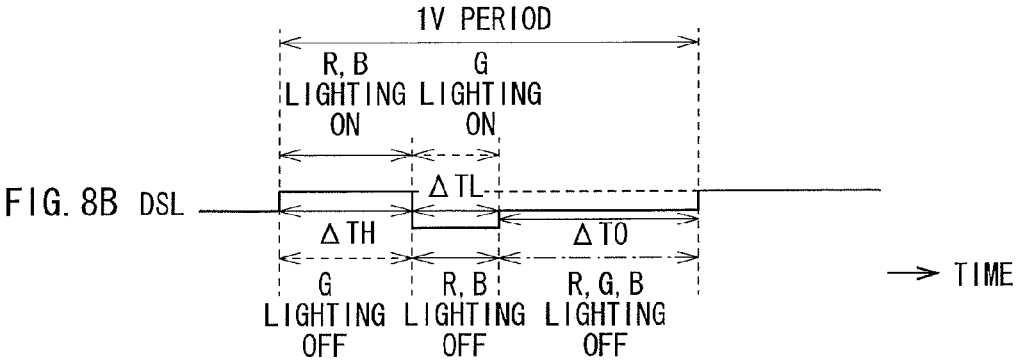

Moreover, for example, as shown in FIG. 8B, the emission-control-line drive circuit 25 may control the control pulses such that a period (period ΔTO in the figure), in which a control pulse has a potential that corresponds to neither the H state nor the L state. The potential that corresponds to neither the H state nor the L state includes, for example, ground potential or an intermediate value of threshold voltages of the transistors Tr3*n* and Tr3*p*. That is, the emission-control-line drive circuit 25 may control the control pulses so as to provide a period in which both the transistors Tr3*n* and Tr3*p* are set to be off. In this way, when a control pulse has the period ΔTO in addition to the H period ΔTH and the L period ΔTL, a period of a non-emission (lighting-off) state may be provided in both of the sub-pixel 11Rn or 11Bn and the sub-pixel 11Gp. More preferably, as shown in the figure, when a period, in which all of the sub-pixels 11Rn, 11Bn and 11Gp are in the non-emission (lighting-off) state, is continuously provided in a 1V period, a residual image may be reduced by a so-called black insertion effect, leading to improvement in moving image characteristic.

As hereinbefore, in the first embodiment, control pulses are applied to the emission control line DSL connected to each pixel 11, thereby an on/off state of the emission control transistor Tr3*n* or Tr3*p* is controlled so as to control emission operation and non-emission operation of the organic EL element 12. In addition, each of the sub-pixels in the pixel array section 13 includes one of the sub-pixel (sub-pixel 11Rn or 11Bn) including the n-channel emission control transistor Tr3*n* and the sub-pixel (sub-pixel 11Gp) including the p-channel emission control transistor Tr3*p*. Thus, the emission control line DSL may be used to adjust an emission period of each of the sub-pixels 11Rn, 11Bn and 11Gp into two types. Furthermore, since one emission control line DSL is connected in common with both of the sub-pixels 11Rn and 11Bn including the n-channel emission control transistors Tr3*n* and the sub-pixel 11Gp including the p-channel emission control transistor Tr3*p*, a small number of emission control lines are used compared with in the past. Accordingly, an emission period may be adjusted into multiple types (two types) with reduction in cost being achieved.

Moreover, improvement in element reliability due to increase in aperture ratio of each pixel 11, reduction in fraction defective due to increase in clearance between emission control lines, improvement in design due to reduction in off-effective-screen size caused by reduction in scale of the drive circuit 20 may be achieved, and besides, when an external integrated-circuit is used for the drive circuit 20, reduction in size and cost may be achieved due to reduction in number of outputs.

Furthermore, even when an aperture ratio of each pixel 11 is decreased to reduce reflection of outside light, emission time is lengthened for each of sub-pixels instead of increasing current density, so that a certain luminance may be obtained. That is, reduction in reflection of outside light and suppression of element degradation may be achieved together.

2. Modifications

Next, modifications (modifications 1 to 3) of the first embodiment will be described. The same components as in the embodiment are marked with the same reference numerals or signs, and description of them is appropriately omitted.

(Modification 1)

Figure 9A:
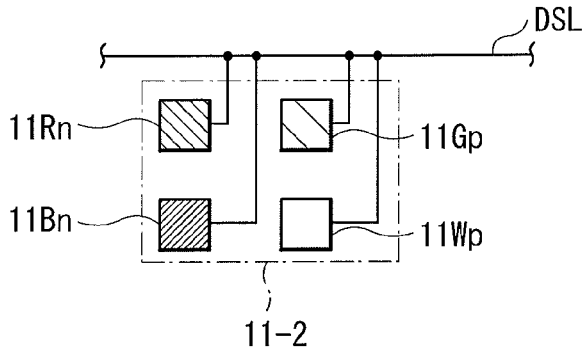
FIGS. 9A and 9B are diagrams, each showing a sub-pixel structure and a connection structure of an emission control line in each pixel according to modification 1 of the first embodiment.
Figure 9B:
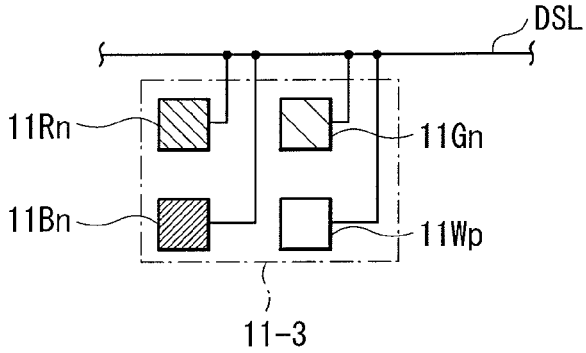

FIGS. 9A and 9B schematically show a connection structure of an emission control line DSL to sub-pixels in a pixel (pixel 11-2 or 11-3) according to modification 1, respectively. In the modification, each pixel is configured of four sub-pixels corresponding to four colors of red (R), blue (B), green (G) and white (W) as will be described below.

Specifically, while lines other than the emission control line are not shown in the pixel 11-2 shown in FIG. 9A, a sub-pixel 11Rn including the n-channel emission control transistor Tr3*n* is connected with a signal line DTLr, a scan line WSL and the emission control line DSL. Similarly, a sub-pixel 11Bn including the n-channel emission control transistor Tr3*n* is connected with a signal line DTLb, the scan line WSL and the emission control line DSL. On the other hand, a sub-pixel 11Gp including the p-channel emission control transistor Tr3*p* is connected with a signal line DTLg, the scan line WSL and the emission control line DSL. Similarly, a sub-pixel 11Wp including the p-channel emission control transistor Tr3*p* is connected with a signal line DTLw, the scan line WSL and the emission control line DSL.

That is, the sub-pixels 11Rn, 11Bn, 11Gp and 11Wp are individually connected with the signal lines DTLr, DTLb, DTLg and DTLw corresponding to the respective colors, and connected in common with the scan line WSL and the emission control line DSL. In other words, one emission control line DSL is connected in common with at least one of the sub-pixels 11Rn and 11Bn including the n-channel emission control transistors Tr3*n* and at least one of the sub-pixels 11Gp and 11Wp including the p-channel emission control transistors Tr3*p*.

On the other hand, while lines other than the emission control line are not shown in the pixel 11-3 shown in FIG. 9B, a sub-pixel 11Rn including the n-channel emission control transistor Tr3*n* is connected with a signal line DTLr, a scan line WSL and the emission control line DSL. Similarly, a sub-pixel 11Bn including the n-channel emission control transistor Tr3*n* is connected with a signal line DTLb, the scan line WSL and the emission control line DSL. A sub-pixel 11Gn including the n-channel emission control transistor Tr3*n* is connected with a signal line DTLg, the scan line WSL and the emission control line DSL. On the other hand, a sub-pixel 11Wp including the p-channel emission control transistor Tr3*p* is connected with a signal line DTLw, the scan line WSL and the emission control line DSL.

That is, the sub-pixels 11Rn, 11Bn, 11Gn and 11Wp are individually connected with the signal lines DTLr, DTLb, DTLg and DTLw corresponding to the respective colors, and connected in common with the scan line WSL and the emission control line DSL. In other words, one emission control line DSL is connected in common with at least one of the sub-pixels 11Rn, 11Bn and 11Gn including the n-channel emission control transistors Tr3*n* and at least one sub-pixel 11Wp including the p-channel emission control transistor Tr3*p*.

Even in the modification configured in this way, the same effects as in the first embodiment may be obtained through the same operation. That is, an emission period may be adjusted into multiple types (two types) with reduction in cost being achieved.

Even in the modification, the same as in the first embodiment holds true for a combination of sub-pixels using emission control transistors with the same type of channel. That is, for example, emission control transistors with the same type of channel (n-channel or p-channel) are desirably used in sub-pixels having organic EL elements having relatively similar values of luminous efficiency among organic EL elements 12R, 12G, 12B and 12W (the organic EL element 12W is not shown). Specifically, for example, emission control transistors with one type of channel are used in sub-pixels 11W, 11R and 11G corresponding to white, red and green, respectively, and an emission control transistor with another type of channel is singly used in a sub-pixel 11B corresponding to blue. Moreover, for example, emission control transistors with one type of channel are used in the sub-pixels 11R, 11G and 11B corresponding to red, green and blue, respectively, and an emission control transistor with another type of channel is singly used in the sub-pixel 11W corresponding to white.

Alternatively, for example, emission control transistors with the same type of channel (n-channel or p-channel) are desirably used in sub-pixels having relatively similar values of luminosity factors (visibility) specific to respective colors of R, G, B and W. Specifically, for example, emission control transistors with one type of channel are used in the sub-pixels 11W and 11G corresponding to white and green, respectively, and an emission control transistors with another type of channel are used in the sub-pixels 11R and 11B corresponding to red and blue, respectively.

(Modification 2)

Figure 10A:
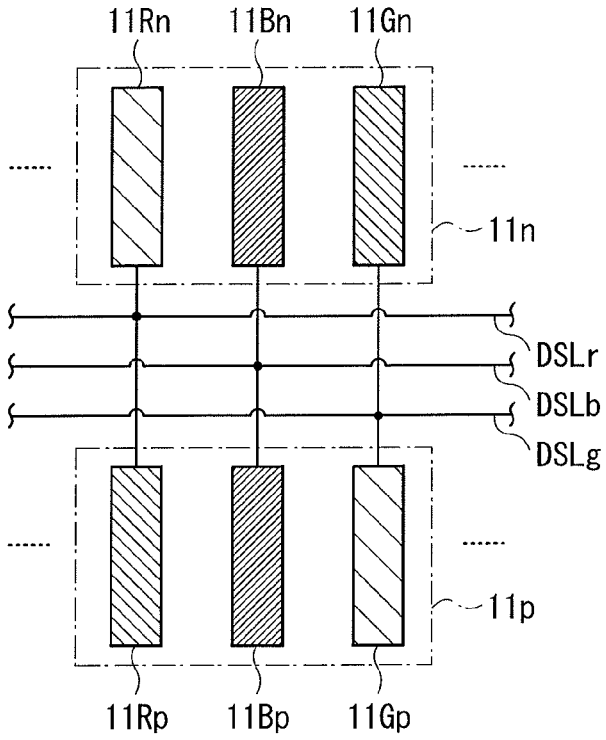
FIGS. 10A and 10B are diagrams, each showing a sub-pixel structure and a connection structure of an emission control line in each pixel according to modification 2 of the first embodiment.
Figure 10B:
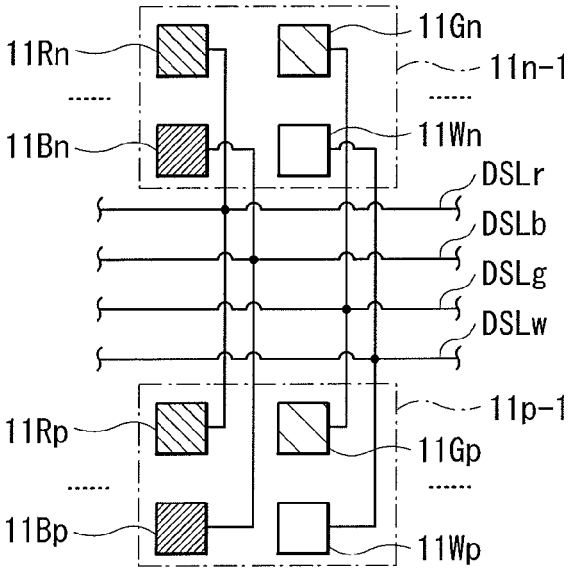

FIGS. 10A and 10B schematically show a connection structure of an emission control line DSL (emission control lines DSLr, DSLb, DSLg and DSLw) to sub-pixels in a pixel (pixel 11*n*, 11*p*, 11*n*-1 or 11*p*-1) according to modification 2, respectively.

In FIG. 10A, sub-pixels 11Rn, 11Bn and 11Gn using the n-channel emission control transistors Tr3*n* are selectively provided in a pixel 11*n* on one horizontal line (for example, an odd line: first horizontal line). In addition, sub-pixels 11Rp, 11Bp and 11Gp using the p-channel emission control transistors Tr3*p* are selectively provided in a pixel 11*p* on another horizontal line (for example, an even line: second horizontal line). A plurality of (here, three) emission control lines DSLr, DSLb and DSLg for individual-color sub-pixels are connected in common to the pixels 11*n* and 11*p*, respectively. Specifically, the emission control line DSLr is connected in common to the sub-pixel 11Rn in the pixel 11*n* and the sub-pixel 11Rp in the pixel 11*p*. The emission control line DSLb is connected in common to the sub-pixel 11Bn in the pixel 11*n* and the sub-pixel 11Bp in the pixel 11*p*. The emission control line DSLg is connected in common to the sub-pixel 11Gn in the pixel 11*n* and the sub-pixel 11Gp in the pixel 11*p*.

In FIG. 10B, sub-pixels 11Rn, 11Bn, 11Gn and 11Wn using the n-channel emission control transistors Tr3*n* are selectively provided in a pixel 11*n*-1 on one horizontal line (for example, an odd line: first horizontal line). In addition, sub-pixels 11Rp, 11Bp, 11Gp and 11Wp using the p-channel emission control transistors Tr3*p* are selectively provided in a pixel 11*p*-1 on another horizontal line (for example, an even line: second horizontal line). A plurality of (here, four) emission control lines DSLr, DSLb, DSLg and DSLw for individual-color sub-pixels are connected in common to the pixels 11*n*-1 and 11*p*-1, respectively. Specifically, the emission control line DSLr is connected in common to the sub-pixel 11Rn in the pixel 11*n*-1 and the sub-pixel 11Rp in the pixel 11*p*-1. The emission control line DSLb is connected in common to the sub-pixel 11Bn in the pixel 11*n*-1 and the sub-pixel 11Bp in the pixel 11*p*-1. The emission control line DSLg is connected in common to the sub-pixel 11Gn in the pixel 11*n*-1 and the sub-pixel 11Gp in the pixel 11*p*-1. The emission control line DSLw is connected in common to the sub-pixel 11Wn in the pixel 11*n*-1 and the sub-pixel 11Wp in the pixel 11*p*-1.

In this way, in the modification, sub-pixels using the n-channel emission control transistors Tr3*n* and sub-pixels using the p-channel emission control transistors Tr3*p* are not provided in correspondence to a color of each sub-pixel as described hereinbefore, and selectively provided in correspondence to a position of a horizontal line (H line) on a display screen, therefore while a control line for adjusting an emission period is not individually provided in correspondence to a position of a horizontal line, timing of an emission period may be varied into multiple types (two types) in correspondence to a position of a horizontal line. Accordingly, for example, when odd and even field images are formed respectively, emission timing may be adjusted into multiple types (two types) with reduction in cost being achieved.

(Modification 3)

Figure 11A:
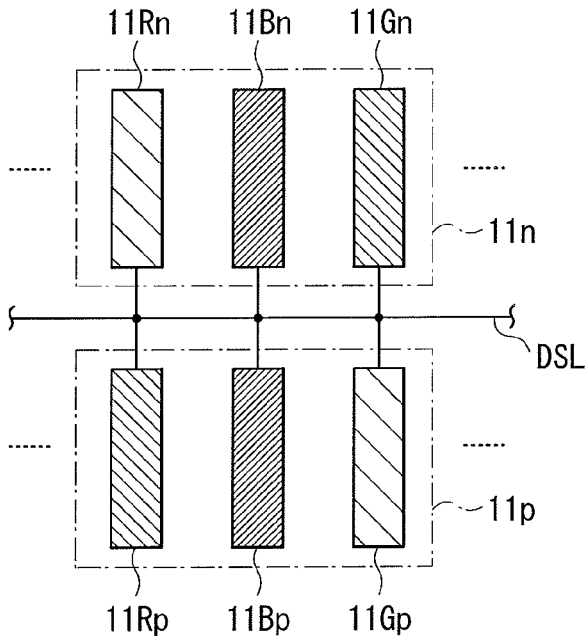
FIGS. 11A and 11B are diagrams, each showing a sub-pixel structure and a connection structure of an emission control line in each pixel according to modification 3 of the first embodiment.
Figure 11B:
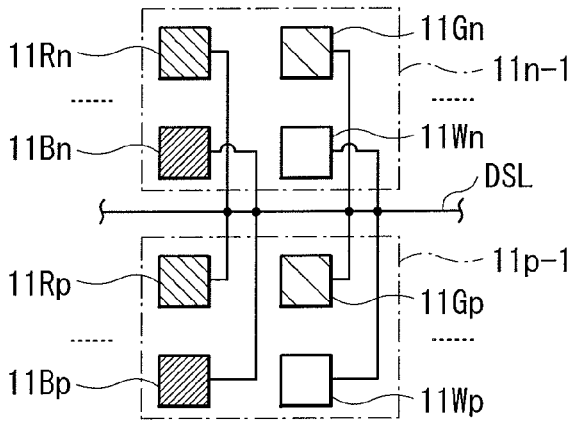

FIGS. 11A and 11B schematically show a connection structure of an emission control line DSL to sub-pixels in a pixel (pixel 11*n*, 11*p*, 11*n*-1 or 11*p*-1) according to modification 3. The modification corresponds to a combination of the first embodiment or the modification 1 and the modification 2.

In FIG. 11A, sub-pixels 11Rn, 11Bn and 11Gn are selectively provided in a pixel 11*n* on one horizontal line (for example, an odd line: first horizontal line). In addition, sub-pixels 11Rp, 11Bp and 11Gp are selectively provided in a pixel 11*p* on another horizontal line (for example, an even line: second horizontal line). An emission control line DSL is connected in common to the pixels 11*n* and 11*p*. Specifically, the emission control line DSL is connected in common to the sub-pixels 11Rn, Bn and Gn in the pixel 11*n* and the sub-pixels 11Rp, 11Bp and 11Gp in the pixel 11*p*. That is, one emission control line DSL is connected in common to all the sub-pixels 11Rn, 11Bn and 11Gn in the pixel 11*n* on one horizontal line and all the sub-pixels 11Rp, 11Bp and 11Gp in the pixel 11*p* on another horizontal line.

In FIG. 11B, sub-pixels 11Rn, 11Bn, 11Gn and 11Wn are selectively provided in a pixel 11*n*-1 on one horizontal line (for example, an odd line: first horizontal line). In addition, sub-pixels 11Rp, 11Bp, 11Gp and 11Wp are selectively provided in a pixel 11*p*-1 on another horizontal line (for example, an even line: second horizontal line). An emission control line DSL is connected in common to the pixels 11*n*-1 and 11*p*-1.

Specifically, the emission control line DSL is connected in common to the sub-pixels 11Rn, 11Bn, 11Gn and 11Wn in the pixel 11*n*-1 and the sub-pixels 11Rp, 11Bp, 11Gp and 11Wp in the pixel 11*p*-1. That is, one emission control line DSL is connected in common to all the sub-pixels 11Rn, 11Bn, 11Gn and 11Wn in the pixel 11*n*-1 on one horizontal line and to all the sub-pixels 11Rp, 11Bp, 11Gp and 11Wp in the pixel 11*p*-1 on another one horizontal line.

In this way, in the modification, the same effect as in the modification 2 is obtained, and besides, since a common emission control line DSL is connected to all sub-pixels in each pixel, the number of emission control lines may be reduced, leading to further reduction in cost.

(Other Modifications)

While the invention has been described with the first embodiment and the modifications hereinbefore, the invention is not limited to the first embodiment and the like, and may be variously modified or altered.

For example, while the first embodiment and the like have been described with a case where the display device 1 is an active-matrix device, a configuration of the pixel circuit 14 for active matrix drive is not limited to that described in the first embodiment and the like. That is, a capacitance element, a transistor or the like may be added to the pixel circuit 14*n* or 14*p* or replaced therein as necessary. In such a case, a necessary drive circuit may be added in addition to the scan line drive circuit 23, the signal line drive circuit 24, and the emission-control-line drive circuit 25 in accordance with change in the pixel circuit 14*n* or 14*p*.

While the first embodiment and the like have been described with a case where the timing generation circuit 22 controls drive operation of each of the scan line drive circuit 23, the signal line drive circuit 24, and the emission-control-line drive circuit 25, another circuit may control the drive operation. Such control of each of the scan line drive circuit 23, the signal line drive circuit 24, and the emission-control-line drive circuit 25 may be performed by hardware (circuit) or software (program).

Furthermore, while the first embodiment and the like have been described with a case where the write transistor Tr1 and the drive transistor Tr2 are formed of n-channel transistors (for example, n-channel MOS TFT), respectively, the case is not limitative. That is, the write transistor Tr1 and the drive transistor Tr2 may be formed of p-channel transistors (for example, p-channel MOS TFT), respectively.

In addition, while the first embodiment and the like have been described with a case where an organic EL element is used as an example of a light emitting element, the invention is not limitedly applied to such a case, and may be applied to cases using other light emitting elements such as an inorganic EL element, FED and PDP.

3. Second Embodiment

Figure 13A:
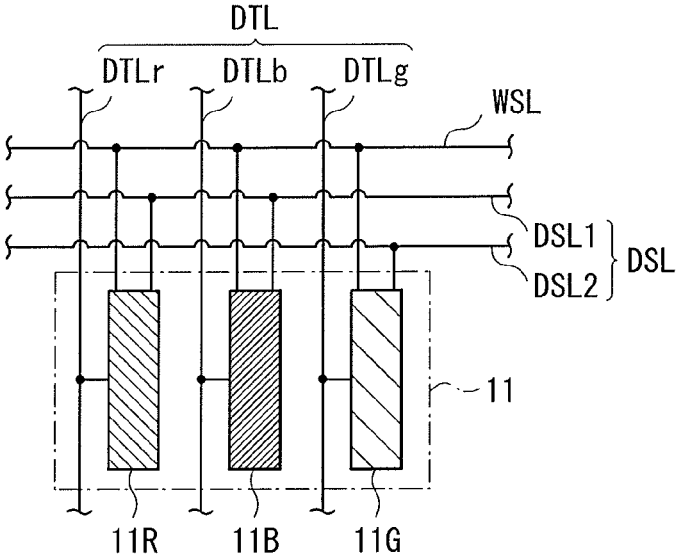
FIGS. 13A to 13C are schematic diagrams, each showing an example of a sub-pixel structure and a connection structure of each wiring line in each pixel shown in FIG. 12.
Figure 13B:
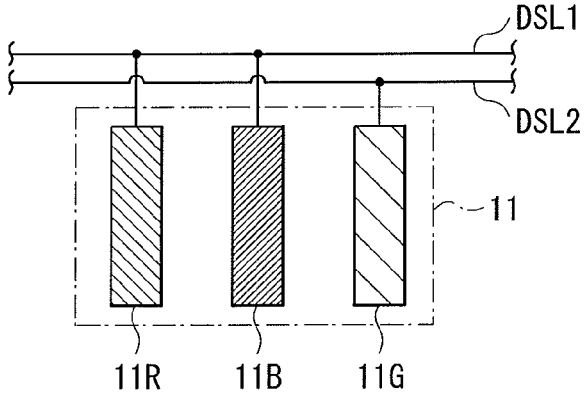
Figure 13C:
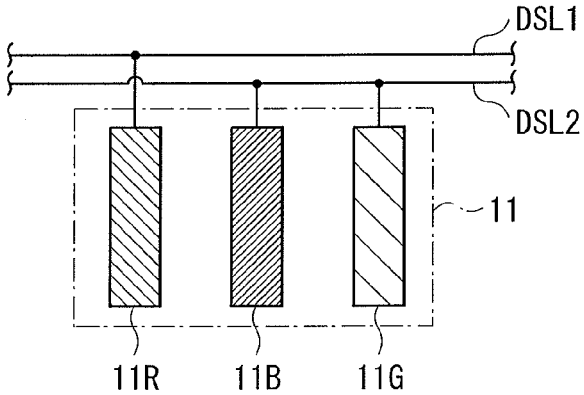

FIGS. 13A to 13C schematically show an internal configuration of each pixel 11 together with wiring lines in the second embodiment, respectively.

Each pixel 11 is configured of three sub-pixels 11R, 11B and 11G corresponding to three primary colors of red (R), blue (B) and green (G), for example, as shown in FIG. 13A. Here, the sub-pixel 11R is connected with a signal line DTLr, a scan line WSL and an emission control line DSL1. The sub-pixel 11B is connected with a signal line DTLb, the scan line WSL and the emission control line DSL1. The sub-pixel 11G is connected with a signal line DTLg, the scan line WSL and an emission control line DSL2.

That is, the sub-pixels 11R, 11B and 11G are individually connected with the signal lines DTLr, DTLb and DTLg corresponding to the respective colors, but connected in common with the scan line WSL. Here, two sub-pixels 11R and 11B are connected in common with one emission control line DSL1 between the two emission control lines DSL1 and DSL2, and remaining one sub-pixel 11G is connected with the other emission control line DSL2. In other words, in each pixel 11, one of the two emission control lines DSL1 and DSL2 is assigned and connected to each of the sub-pixels 11R, 11B and 11G. At least one (here, only one emission control line DSL1) of the two emission control lines DSL1 and DSL2 is connected in common to at least two (here, two) sub-pixels 11R and 11B among the three sub-pixels 11R, 11B and 11G.

FIG. 13B shows a wiring structure shown in FIG. 13A in a simplified manner, showing only the emission control line DSL among the signal line DTL, the scan line WSL and the emission control line DSL for convenience. Hereinafter, in figures showing similar wiring structures, a wiring structure is shown in a simplified manner (only the emission control line DSL is shown) as in FIG. 13B, and other wiring lines (the signal line DTL and the scan line WSL) are basically structured in the same way as in FIG. 13A.

A connection structure of the emission control lines DSL1 and DSL2 to the sub-pixels 11R, 11B and 11G in each pixel 11 is not limited to that shown in FIGS. 13A and 13B, and other connection structures may be used. That is, it is acceptable that one sub-pixel 11R is connected with one emission control line DSL1, and remaining two sub-pixels 11B and 11G are connected with the other emission control line DSL2, for example, as shown in FIG. 13C.

However, for example, the emission control line DSL1 or DSL2 is desirably connected in common to sub-pixels having organic EL elements having relatively similar values of luminous efficiency among organic EL elements (organic EL elements 12R, 12G and 12B) emitting respective color light as described later. Specifically, for example, as shown in FIG. 13B, one emission control line is connected in common to a sub-pixel 11R corresponding to red and a sub-pixel 11G corresponding to green, and the other emission control line is singly connected to a sub-pixel 11B corresponding to blue. In such a configuration, when an emission period of each of the sub-pixels 11R, 11G and 11B is controlled as described later, effective control may be performed in correspondence to magnitude of luminous efficiency.

Alternatively, for example, the emission control line DSL1 or DSL2 is desirably connected in common to sub-pixels having relatively similar values of luminosity factors (visibility) specific to respective colors of R, G and B. Specifically, even in this case, for example, as shown in FIG. 13B, one emission control line is connected in common to the sub-pixel 11R corresponding to red and the sub-pixel 11G corresponding to green, and the other emission control line is singly connected to the sub-pixel 11B corresponding to blue. In such a configuration, when an emission period is controlled in the same way as above, effective control may be performed in correspondence to magnitude of a luminosity factor (visibility).

Figure 14:
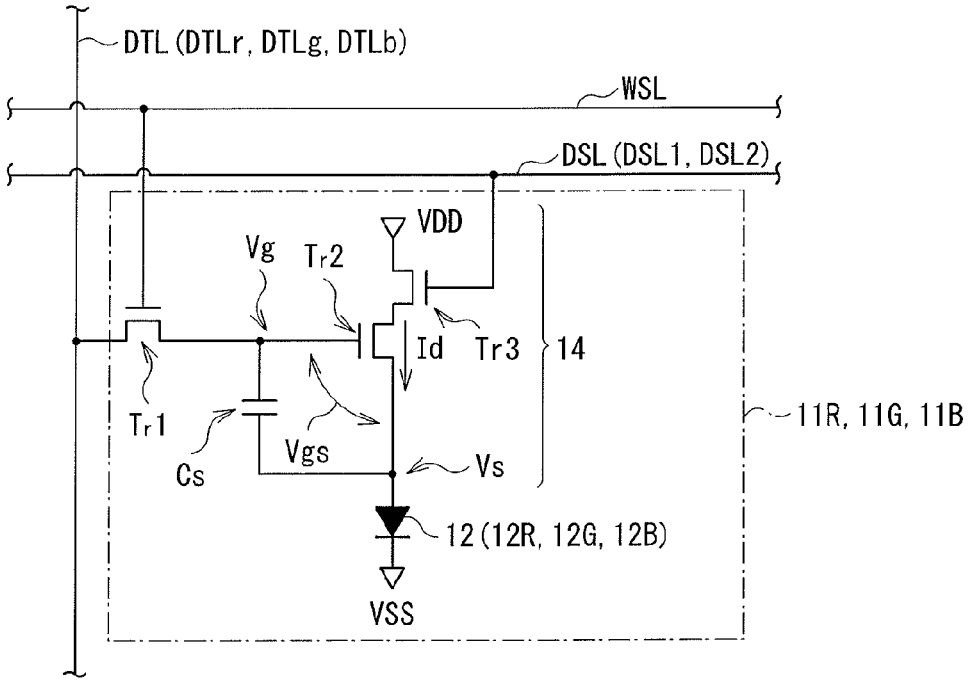
FIG. 14 is a circuit diagram showing an example of an internal configuration of each sub-pixel shown in FIG. 13.

FIG. 14 shows an example of an internal configuration (circuit configuration) of each of sub-pixels 11R, 11G and 11B. An organic EL element 12R, 12G or 12B (individual-color light emitting element) and a pixel circuit 14 are provided in the sub-pixel 11R, 11G or 11B. Hereinafter, a term, organic EL element 12, is appropriately used as a general term of the organic EL elements 12R, 12G and 12B.

The pixel circuit 14 includes a write (sampling) transistor Tr1 (first transistor), a drive transistor Tr2 (second transistor), an emission control transistor Tr3 (third transistor), and a capacitance element Cs. That is, the pixel circuit 14*n* has a circuit configuration of so-called 3Tr1C. The write transistor Tr1, the drive transistor Tr2, and the emission control transistor Tr3 are formed of n-channel MOS (Metal Oxide Semiconductor) TFT, respectively. A type of the TFT is not particularly limited, and, for example, may have an inversely staggered structure (so-called bottom gate type) or a staggered structure (so-called top gate type).

In the pixel circuit 14, a gate of the write transistor Tr1 is connected to the scan line WSL, a drain of the transistor is connected to the signal line DTL (DTLr, DTLg or DTLb), and a source thereof is connected to a gate of the drive transistor Tr2 and one end of the capacitance element Cs. A drain of the emission control transistor Tr3 is connected to a stationary power supply VDD, a gate of the transistor is connected to the emission control line DSL (DSL1 or DSL2), and a source thereof is connected to a drain of the drive transistor Tr2. A source of the drive transistor Tr2 is connected to the other end of the capacitance element Cs and an anode of the organic EL element 12, and a cathode of the organic EL element 12 is set to stationary potential VSS (for example, ground potential). The cathode of the organic EL element 12 acts as a common electrode of respective organic EL elements 12, and, for example, is continuously formed as a plate-like electrode over the whole display region of the display panel 10.

(Operation of Characteristic Portion)

Next, operation of a characteristic portion of a display device 1 of the second embodiment will be described in detail in comparison with the comparative example 1 mentioned in description of the first embodiment.

First, in an organic EL display device, a current-voltage (I-V) characteristic of an organic EL element typically degrades with the lapse of time (temporal degradation) as well known. In a pixel circuit that current-drives the organic EL element (for example, the pixel circuit 14 shown in FIG. 14), when the I-V characteristic of the organic EL element is changed with time, a value Id of current flowing into a drive transistor (for example, the drive transistor Tr2 shown in FIG. 14) is changed. Therefore a value of current flowing into the organic EL element itself is changed in accordance with change in the current value Id, and accordingly emission luminance is changed.

Moreover, in the organic EL display device, rate of such degradation of the organic EL element is typically different for each of individual-color sub-pixels as well known. Therefore, when the pixel 11 is configured of sub-pixels 11R, 11B and 11G corresponding to three colors, for example, as in the comparative example 1, temporal color shift occurs in the pixel 11, leading to reduction in display image quality.

In this way, degradation rate is different, for example, for each of the individual-color sub-pixels 11R, 11B and 11G. A reason for this mainly includes a fact that luminous efficiency of an organic EL element (for example, the organic EL element 12R, 12G or 12B in FIG. 14) is different for each of colors. As another reason, in examples of related art including the comparative example 1, density of current (current density) flowing into an organic EL element is set to be different for each of individual-color sub-pixels (for example, the sub-pixels 11Rn, 11Bn and 11Gn) in order to adjust white balance. This is because current density typically needs to be set high in a sub-pixel corresponding to a color, where luminous efficiency of the organic EL element is relatively low, compared with in sub-pixels of other colors, leading to increase in degradation rate.

Thus, for example, the following two methods are considered to suppress temporal color shift caused by such difference in current density. In the first method, an aperture ratio is varied for each of the individual-color sub-pixels 11R, 11B and 11G, thereby degradation rate is equalized between colors while current density is not varied for each of colors unlike the above. In the second method, a plurality of sub-pixels are provided for one color in each pixel 11, thereby degradation rate is equalized between colors while current density is not varied for each of colors as in the first method.

However, in the first method, for example, when the organic EL element 12 is formed by evaporation with a shadow mask, various shadow masks are necessary in correspondence to individual colors to vary an aperture ratio for each of colors. Therefore, the number of manufacturing steps increases compared with a case where the aperture ratio is constant between individual colors (the same kind of shadow mask is used between individual colors), causing increase in cost.

In the second method, for example, when a white line having a width corresponding to width of a pixel is displayed, a high resolution image may be blurred in color or may appear unevenly due to the multiple sub-pixels provided for one color. That is, display image quality is reduced in the second method.

Thus, as a method other than the methods, in the comparative example 1, width of the control pulse (pulse width) (FIG. 4B) is likely to be adjusted to adjust length of an emission period of each of the sub-pixels 11R, 11B and 11G so that degradation rate is equalized between colors. However, in the comparative example 1, one emission control line DSL 101 is connected in common to the three sub-pixels 11R, 11B and 11G in the pixel 11 as described before (FIG. 4A). Therefore, in the comparative example 1, the emission control line DSL 101 may not be used to adjust length of an emission period for each of the sub-pixels 11R, 11B and 11G. That is, all the sub-pixels 11R, 11B and 11G have to perform emission (lighting-on) operation or non-emission (lighting-off) operation at the same timing.

Moreover, even in the case of using the method of the comparative example 2, increase in defective products or the like is caused by reduction in aperture ratio of each pixel or decrease in clearance between lines, and consequently total cost reduction is hardly achieved.

Second Embodiment

In contrast, in the display device 1 of the second embodiment, for example, as shown in FIGS. 13B and 13C, a plurality of emission control lines (here, two emission control lines DSL1 and DSL2) are provided for each pixel 11 unlike in the comparative example 1. In addition, in each pixel 11, one emission control line between the emission control lines DSL1 and DSL2 is assigned and connected to each of the sub-pixels 11R, 11B and 11G corresponding to three colors.

Thus, in the second embodiment, degradation rate may be equalized between colors while a structure (for example, an aperture ratio or number) of each sub-pixel 11R or 11B and current density therein are not varied for each of colors as in the comparative example 2. Specifically, the two emission control lines DSL1 and DSL2 may be used to adjust an emission period of each sub-pixel 11R or 11B may be adjusted into multiple types (two types). That is, while a structure of a sub-pixel 11R or 11B or current density therein is constant between colors, temporal color shift caused by difference in degradation rate for each of colors may be suppressed.

Moreover, in the second embodiment, at least one of the two emission control lines DSL1 and DSL2 is connected in common to at least two (here, two) sub-pixels as a part of the three sub-pixels 11R, 11B and 11G unlike in the comparative example 2. Specifically, for example, in FIG. 13B, the emission control line DSL1 is connected in common to the two sub-pixels 11R and 11B. In addition, for example, in FIG. 13C, the emission control line DSL2 is connected in common to the two sub-pixels 11B and 11G.

Thus, in the second embodiment, a small number of emission control lines are used compared with the comparative example 2 where the emission control lines DSLr, DSLb and DSLg are individually connected to the three sub-pixels 11R, 11B and 11G. That is, in this case, while the three emission control lines DSLr, DSLb and DSLg are used in the comparative example 2, two emission control lines DSL1 and DSL2 are used in the second embodiment.

In the second embodiment, the above adjustment (control) operation of an emission period of each sub-pixel 11R, 11B or 11G using the two emission control lines DSL1 and DSL2 is specifically performed as follows.

Figure 12:
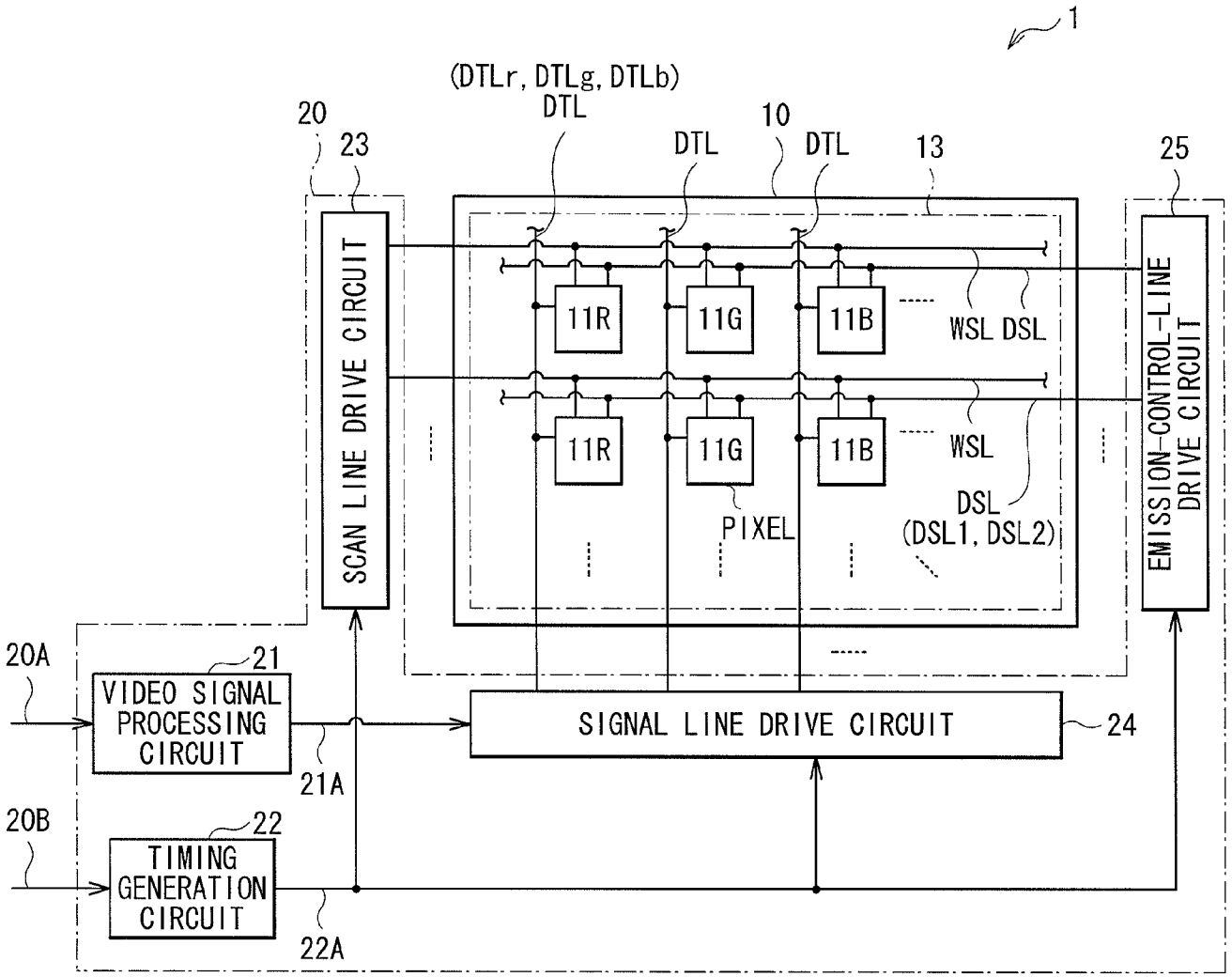
FIG. 12 is a block diagram showing an example of a display device according to second embodiment of the invention.
Figure 15:
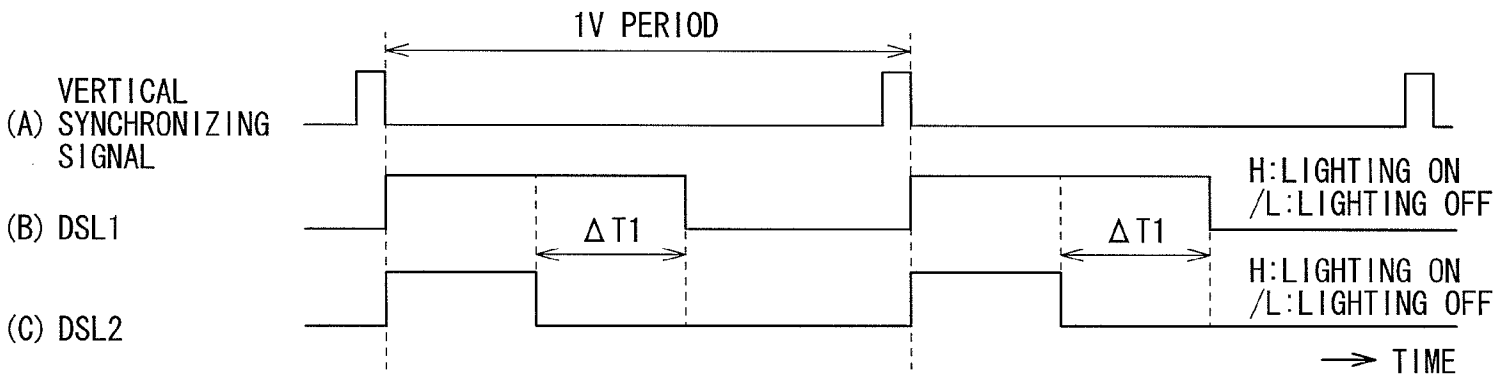
FIG. 15 is a timing waveform diagram showing an example of control pulses applied to each emission control line according to the second embodiment.

That is, for example, as shown in (A) to (C) of FIG. 15, the emission-control-line drive circuit 25 adjusts width of each control pulse applied to the emission control lines DSL1 and DSL2. Specifically, the emission-control-line drive circuit 25 adjusts width of the control pulse such that an emission period is short in a sub-pixel corresponding to a color, where luminous efficiency of the organic EL element 12 is relatively high, compared with a sub-pixel corresponding to a color, where luminous efficiency of the organic EL element 12 is relatively low. For example, here, an emission period is short in a sub-pixel connected with the emission control line DSL2 (sub-pixel 11G in FIG. 13B and sub-pixels 11B and 11G in FIG. 13C) compared with in a sub-pixel connected with the emission control line DSL1 (sub-pixels 11R and 11B in FIG. 13B and sub-pixel 11R in FIG. 13C). A vertical synchronizing signal shown in (A) of FIG. 15 corresponds to one of a control signal 22A, for example, shown in FIG. 12, showing a 1V period (1 vertical period).

However, in the example shown in FIG. 15, since start timing of a H period is the same between the emission control lines DSL1 and DSL2, a period, in which only the emission control line DSL1 is in an H state, is long as shown by an emission period (lighting-in period) ΔT1 in the figure. That is, it is set that that the emission period ΔT1, in which only a sub-pixel as a part of the three sub-pixels 11R, 11B and 11G is in a light-emitting state, is continuously long. In this case, in moving image display, residual color of a color, where emission time is relatively long, may occur in the periphery of an image due to a large difference in emission time between a sub-pixel having a relatively short emission time and a sub-pixel having a relatively long emission time. Specifically, in a boundary of a high contrast color, a sub-pixel having a relatively long emission time may be blurred in color compared with a sub-pixel having a relatively short emission time.

Figure 16:
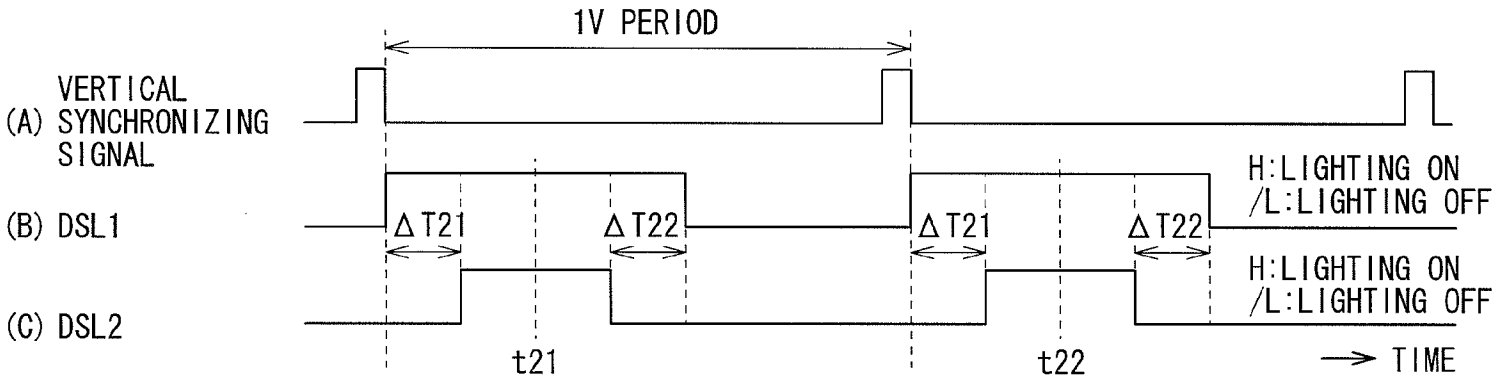
FIG. 16 is a timing waveform diagram showing another example of control pulses applied to each emission control line according to the second embodiment.

Thus, in the second embodiment, width of each control pulse applied to the emission control lines DSL1 and DSL2 is desirably adjusted, for example, as shown in (A) to (C) of FIG. 16. Specifically, width of each control pulse is adjusted such that an emission period of a sub-pixel, which is set to be relatively long in emission period, is provided during and before or after the whole emission period of a sub-pixel, which is set to be relatively short in emission period. In other words, width of each control pulse is adjusted such that the whole emission period of a sub-pixel, which is set to be relatively short in emission period, is included within an emission period of a sub-pixel set to be relatively long in emission period. For example, here, an emission period defined by an H state of the emission control line DSL1 is provided during and before or after the whole emission period defined by an H state of the emission control line DSL2.

Thus, an emission period, in which only a part of the three sub-pixels 11R, 11B and 11G is in a light-emitting state, are divided into two periods (emission periods ΔT21 and ΔT22) before and after the H period (relatively short emission period) of the emission control line DSL2. Thus, since a period, in which only the emission control line DSL1 is continuously in the H state, is reduced compared with in the case as shown in FIG. 15, residual color is reduced in the periphery of an image in moving image display. In this case, it is more desirable that central timing of a relatively long emission period coincides with central timing of a relatively short emission period as shown in timing t21 or t22 in FIG. 16. In such setting, a period, in which only the emission control line DSL1 is continuously in the H state, is most reduced, leading to further reduction in residual color in the periphery of an image in moving image display.

Figure 17:
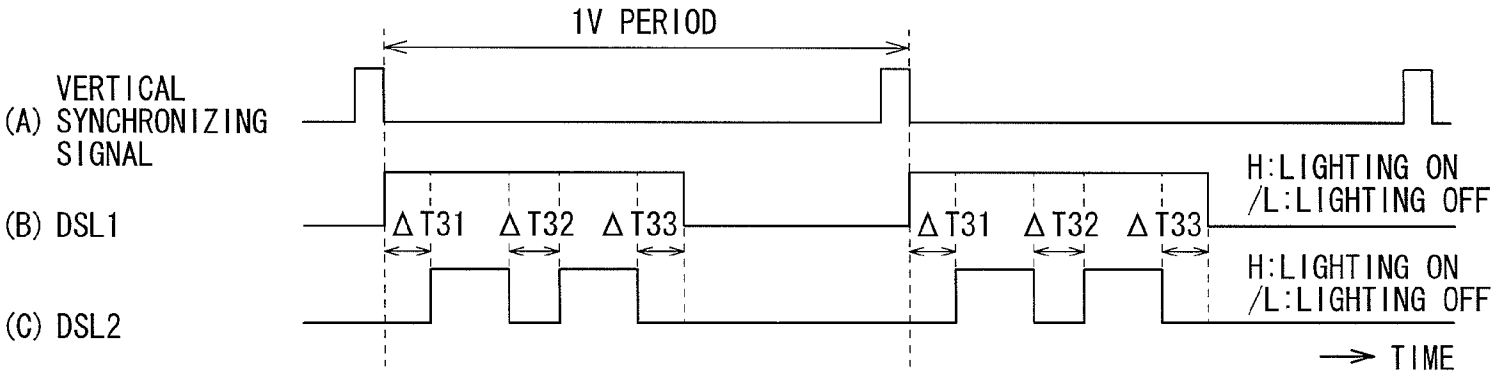
FIG. 17 is a timing waveform diagram showing still another example of control pulses applied to each emission control line according to the second embodiment.

Moreover, in the second embodiment, on the assumption of the case as shown in FIG. 16, an emission period of a sub-pixel is desirably divided into multiple periods separated from one another so that each emission period is further relatively reduced, for example, as shown in (A) to (C) of FIG. 17. Specifically, here, a relatively short emission period (H period of the emission control line DSL2) is divided into two within a relatively long emission period (H period of the emission control line DSL1). Thus, since a period (emission period ΔT31, ΔT32 or ΔT33, in which only the emission control line DSL1 is continuously in the H state, is further reduced compared with in the case as shown in FIG. 16, residual color is further reduced in the periphery of an image in moving image display. Therefore, a division number of the relatively short emission period is set large to the utmost.

Furthermore, in the second embodiment, the H period of the emission control line DSL1 is desirably continuous, for example, as shown in FIGS. 16 and 17. In such a configuration, an L period of the emission control line DSL1 also becomes continuous. As a result, a period, in which both the emission control lines DSL1 and DSL2 are continuously in the L state, or a period, in which any of the sub-pixels 11R, 11B and 11G are continuously in a non-light-emitting state, (black display period) may be ensured long. Consequently, residual images may be reduced, leading to improvement in moving image characteristic.

In this case, the multiply divided emission periods are desirably even (the same) in length as shown by the three emission periods ΔT31, ΔT32 and ΔT33 in FIG. 17. In such setting, a period, in which only the emission control line DSL1 is continuously in the H state, is most reduced, leading to further reduction in residual color in the periphery of an image in moving image display. More preferably, in a 1V period, the barycenter on a temporal axis of a period, in which the emission control line DSL1 is in the H state, coincides with that of a period, in which the emission control line DSL2 is in the H state.

As hereinbefore, in the second embodiment, control pulses are applied to the two emission control lines DSL1 and DSL2 connected to each pixel 11, thereby emission operation and non-emission operation of the three sub-pixels 11R, 11B and 11G corresponding to respective colors are controlled, and one emission control line between the two emission control lines DSL1 and DSL2 is assigned and connected to each of the sub-pixels 11R, 11B and 11G in each pixel 11, therefore while a structure of a sub-pixel 11R, 11B or 11G or current density therein is constant between colors, temporal color shift caused by difference in degradation rate for each of colors may be suppressed. Moreover, since at least one of the two emission control lines DSL1 and DSL2 is connected in common to two sub-pixels as a part of the three sub-pixels 11R, 11B and 11G, such temporal color shift may be suppressed while a smaller number of emission control lines are used. Consequently, image quality may be improved with reduction in cost being achieved. Even in a configuration having at least three emission control lines, the adjustment (control) operation of an emission period of each sub-pixel described hereinbefore is effectively performed based on the same idea.

Moreover, improvement in element reliability due to increase in aperture ration of each pixel 11, reduction in fraction defective due to increase in clearance between emission control lines, improvement in design due to reduction in off-effective-screen size caused by reduction in scale of the drive circuit 20 may be achieved, and besides, when an external integrated-circuit is used for the drive circuit 20, reduction in size and cost may be achieved due to reduction in number of outputs.

Furthermore, even when an aperture ratio of each pixel 11 is decreased to reduce reflection of outside light, emission time is lengthened for each of the sub-pixels 11R, 11B and 11G instead of increasing current density, so that a certain luminance may be obtained. That is, reduction in reflection of outside light and suppression of element degradation may be achieved together.

4. Modifications

Next, modifications (modifications 1 to 4) of the second embodiment will be described. In the modifications, each pixel is configured of four sub-pixels (sub-pixels 11R, 11B, 11G and 11W) corresponding to four colors of red (R), blue (B), green (G) and white (W) as described below. The same components as in the second embodiment are marked with the same reference numerals or signs, and description of them is appropriately omitted.

(Modification 1)

Figure 18A:
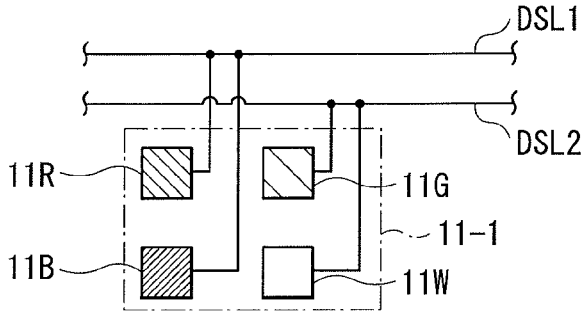
FIGS. 18A to 18D are schematic diagrams, each showing a sub-pixel structure and a connection structure of an emission control line in each pixel according to each of modifications 1 to 4 of the second embodiment.

FIG. 18A schematically shows a connection structure of emission control lines (emission control lines DSL1 and DSL2) to sub-pixels 11R, 11B, 11G and 11W in a pixel (pixel 11-1) according to modification 1.

While lines other than the emission control lines are not shown in FIG. 18A, a sub-pixel 11R is connected with a signal line DTLr, a scan line WSL and the emission control line DSL1. Similarly, a sub-pixel 11B is connected with a signal line DTLb, the scan line WSL and the emission control line DSL1. A sub-pixel 11G is connected with a signal line DTLg, the scan line WSL and the emission control line DSL2. A sub-pixel 11W is connected with a signal line DTLw, the scan line WSL and the emission control line DSL2.

That is, the sub-pixels 11R, 11B, 11G and 11W are individually connected with the signal lines DTLr, DTLb, DTLg and DTLw corresponding to the respective colors, and connected in common with the scan line WSL. Here, two sub-pixels 11R and 11B are connected in common with one emission control line DSL1 between the two emission control lines DSL1 and DSL2, and remaining two sub-pixels 11G and 11W are connected with the other emission control line DSL2. In other words, in each pixel 11, one of the two emission control lines DSL1 and DSL2 is assigned and connected to each of the sub-pixels 11R, 11B, 11G and 11W. At least one of the two emission control lines DSL1 and DSL2 (here, both the emission control lines DSL1 and DSL2) is connected in common to at least two (here, two) sub-pixels among the four sub-pixels 11R, 11B, 11G and 11W.

(Modification 2)

Figure 18B:
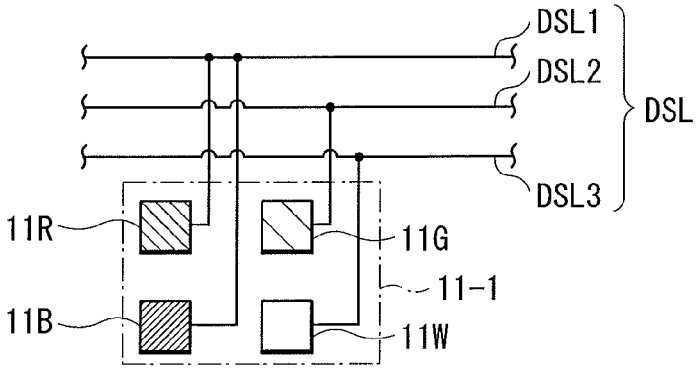

FIG. 18B schematically shows a connection structure of emission control lines DSL1, DSL2 and DSL3 to sub-pixels 11R, 11B, 11G and 11W in a pixel 11-1 according to modification 2.

Even in the modification, the sub-pixels 11R, 11B, 11G and 11W are individually connected with signal lines DTLr, DTLb, DTLg and DTLw corresponding to the respective colors, and connected in common with the scan line WSL. In addition, in the modification, two sub-pixels 11R and 11B are connected in common with the emission control line DSL1 among the three emission control lines DSL1 to DSL3, one sub-pixel 11G is connected with the emission control line DSL2, and one sub-pixel 11W is connected with the emission control line DSL3.

In this way, the number of emission control lines connected to the sub-pixels 11R, 11B, 11G and 11W is not limited to two as in the modification 1, and may be three as in the modification. Moreover, a connection structure of the emission control lines DSL1, DSL2 and DSL3 to the sub-pixels 11R, 11B, 11G and 11W is not limited to that described in the modification, and other connection structures may be used.

(Modification 3)

Figure 18C:
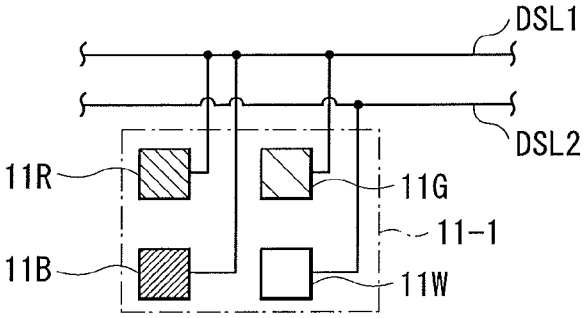

FIG. 18C schematically shows a connection structure of emission control lines DSL1 and DSL2 to sub-pixels 11R, 11B, 11G and 11W in a pixel 11-1 according to modification 3.

Even in the modification, the sub-pixels 11R, 11B, 11G and 11W are individually connected with signal lines DTLr, DTLb, DTLg and DTLw corresponding to the respective colors, and connected in common with the scan line WSL. In addition, in the modification, three sub-pixels 11R, 11B and 11G are connected in common with one emission control line DSL1 between the emission control lines DSL1 and DSL2, and remaining one sub-pixel 11W is connected with the other emission control line DSL2.

In this way, a connection structure of the emission control lines DSL1 and DSL2 to the sub-pixels 11R, 11B, 11G and 11W is not limited to that described in the modification 1, and other connection structures may be used.

(Modification 4)

Figure 18D:
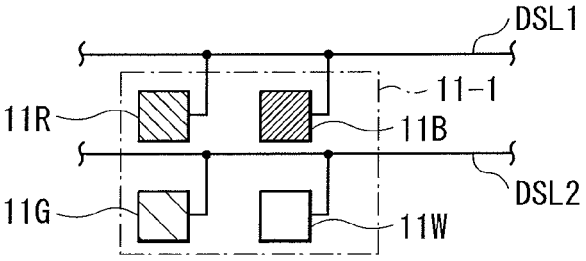

FIG. 18D schematically shows a connection structure of emission control lines DSL1 and DSL2 to sub-pixels 11R, 11B, 11G and 11W in a pixel 11-1 according to modification 4.

Even in the modification, the sub-pixels 11R, 11B, 11G and 11W are individually connected with signal lines DTLr, DTLb, DTLg and DTLw corresponding to the respective colors, and connected in common with the scan line WSL. However, in the modification, two sub-pixels 11R and 11B are disposed in an upper region, and two sub-pixels 11G and 11W are disposed in a lower region in the pixel 11-1 unlike in the modifications 1 to 3. One emission control line DSL1 between the two emission control lines DSL1 and DSL2 is connected in common to the upper two sub-pixels 11R and 11B, and the other emission control line DSL2 is connected in common to the lower two sub-pixels 11G and 11W.

In this way, in the modification, since sub-pixels, which are disposed along an extending direction (here, a right-and-left direction in the figure) of the emission control lines DSL1 and DSL2, are grouped and connected in common, a wiring structure of the emission control lines DSL1 and DSL2 may be simplified. In this way, a combination of sub-pixels to be connected in common is selected based on a positional relationship between sub-pixels, thereby a wiring structure of the emission control lines may be simplified, leading to improvement in yield or increase in aperture ratio.

Even in the modifications 1 to 4, the same effects as in the second embodiment may be obtained through the same operation. That is, image quality may be improved with reduction in cost being achieved.

Even in the modifications 1 to 4, the same as in the second embodiment holds true for a combination of sub-pixels connected in common with an emission control line. That is, for example, an emission control line is desirably connected in common to sub-pixels having organic EL elements having relatively similar values of luminous efficiency among organic EL elements 12R, 12G, 12B and 12W (the organic EL element 12W is not shown). Specifically, for example, one emission control line is connected in common to sub-pixels 11W, 11R and 11G corresponding to white, red and green, respectively, and the other emission control line is singly connected to a sub-pixel 11B corresponding to blue. Moreover, for example, one emission control line is connected in common to sub-pixels 11R, 11G and 11B corresponding to red, green and blue, respectively, and the other emission control line is singly connected to a sub-pixel 11W corresponding to white.

Alternatively, for example, an emission control line is desirably connected in common to sub-pixels having relatively similar values of luminosity factors (visibility) specific to respective colors of R, G, B and W. Specifically, for example, an emission control line is connected in common to the sub-pixels 11W and 11G corresponding to white and green, respectively, and the other emission control line is connected in common to the sub-pixels 11R and 11B corresponding to red and blue, respectively.

(Other Modifications)

While the invention has been described with the second embodiment and modifications thereof hereinbefore, the invention is not limited to the second embodiment and the like, and may be variously modified or altered.

For example, while the second embodiment and the like have been described on the assumption of the case where at least one of multiple emission control lines is connected in common to at least two sub-pixels as a part of multiple sub-pixels, for example, as shown in FIGS. 13A to 13C and FIGS. 18A to 18D, the case is not limitative. That is, adjustment (control) operation of an emission period of each sub-pixel may be performed with a plurality of emission control lines without assuming such common connection of an emission control line, for example, as shown in FIG. 16 or 17.

Moreover, while the second embodiment and the like have been described with a case where the display device 1 is an active-matrix device, a configuration of the pixel circuit 14 for active matrix drive is not limited to that described in the embodiment and the like. That is, a configuration of the pixel circuit 14 is not limited to the circuit configuration of 3Tr1C described in the second embodiment and the like, and, for example, a capacitance element, a transistor or the like may be added to the pixel circuit 14 or replaced therein as necessary. In such a case, a necessary drive circuit may be added in addition to the scan line drive circuit 23, the signal line drive circuit 24, and the emission-control-line drive circuit 25 in accordance with change in the pixel circuit 14.

Furthermore, while the second embodiment and the like have been described with a case where the timing generation circuit 22 controls drive operation of each of the scan line drive circuit 23, the signal line drive circuit 24, and the emission-control-line drive circuit 25, another circuit may control the drive operation. Such control of the scan line drive circuit 23, the signal line drive circuit 24, and the emission-control-line drive circuit 25 may be performed by hardware (circuit) or software (program).

In addition, while the second embodiment and the like have been described with a case where the write transistor Tr1, the drive transistor Tr2 and the emission control transistor Tr3 are formed of n-channel transistors (for example, n-channel MOS TFT), respectively, the case is not limitative. That is, the write transistor Tr1, the drive transistor Tr2 and the emission control transistor Tr3 may be formed of p-channel transistors (for example, p-channel MOS TFT), respectively.

5. Module and Application Examples

Next, application examples of the display device 1 described in the embodiments and the modifications will be described. The display device 1 of the embodiments and the like may be applied to electronic devices in any field, such as a television apparatus, a digital camera, a notebook personal computer, a mobile terminal such as mobile phone, or a video camera. In other words, the display device 1 may be applied to electronic devices in any field for displaying still or video images based on an externally-input or internally-generated video signal.

Module

Figure 19:
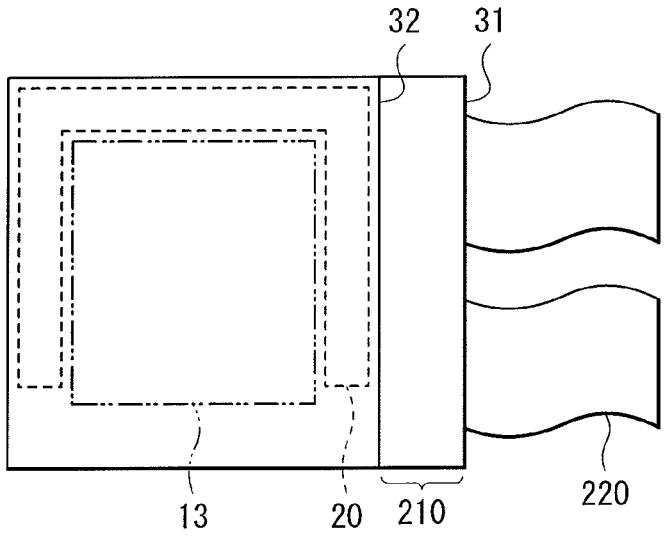
FIG. 19 is a plan diagram showing a schematic configuration of a module including a display device of each embodiment or each modification.

The display device 1 may be built in various electronic devices such as application examples 1 to 5 described later, for example, in a form of a module shown in FIG. 19. In the module, for example, a region 210 exposed from a sealing substrate 32 is provided in one side of a substrate 31, and external connection terminals (not shown) are formed in the exposed region 210 by extending wiring lines of a drive circuit 20. The external connection terminals may be attached with a flexible printed circuit (FPC) 220 for input or output of signals.

Application Example 1

Figure 20:
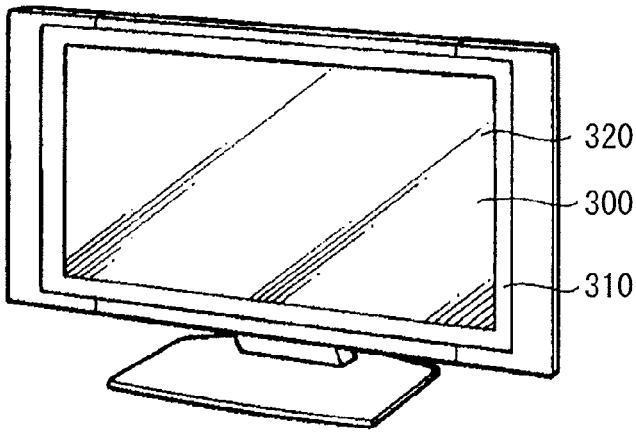
FIG. 20 is a perspective diagram showing appearance of application example 1 of the display device of each embodiment or each modification.

FIG. 20 shows appearance of a television apparatus using the display device 1. The television apparatus has, for example, an image display screen 300 including a front panel 310 and filter glass 320, and the image display screen 300 is configured of the display device 1.

Application Example 2

Figure 21A:
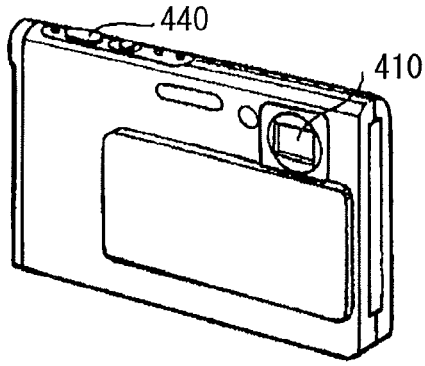
FIGS. 21A and 21B are perspective diagrams, where
Figure 21B:
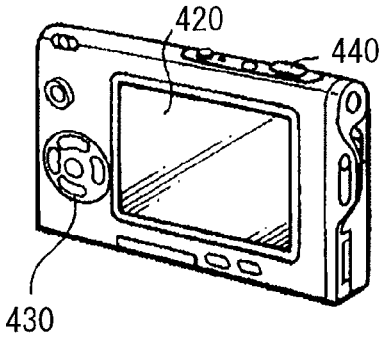

FIGS. 21A and 21B show appearance of a digital camera using the display device 1. The digital camera has, for example, a light emitting section for flash 410, a display 420, a menu switch 430 and a shutter button 440, and the display 420 is configured of the display device 1.

Application Example 3

Figure 22:
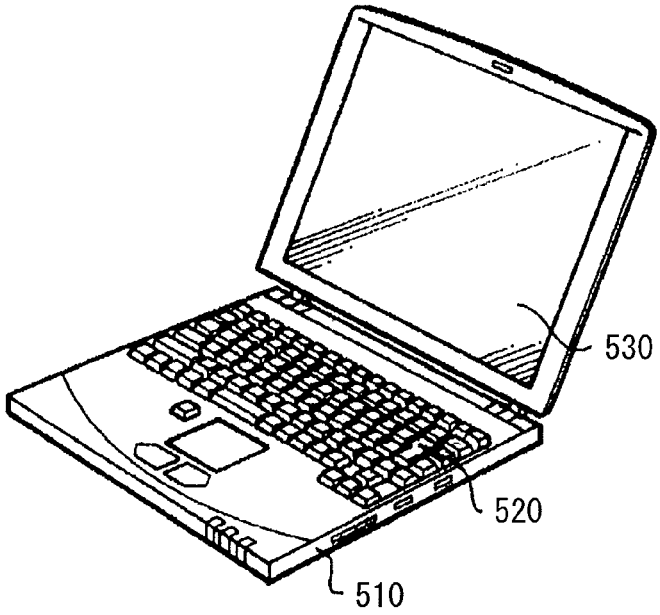
FIG. 22 is a perspective diagram showing appearance of application example 3.

FIG. 22 shows appearance of a notebook personal computer using the display device 1. The notebook personal computer has, for example, a body 510, a keyboard 520 for input operation of letters and the like, and a display 530 for displaying images, and the display 530 is configured of the display device 1.

Application Example 4

Figure 23:
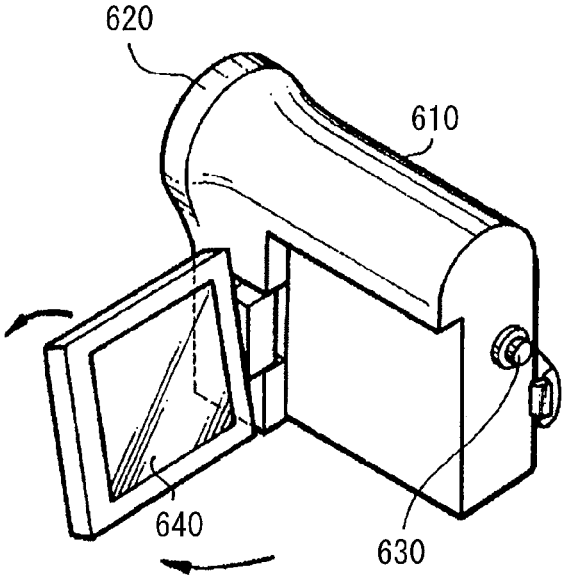
FIG. 23 is a perspective diagram showing appearance of application example 4.

FIG. 23 shows appearance of a video camera using the display device 1. The video camera has, for example, a body 610, an object-shooting lens 620 provided on a front side-face of the body 610, a start/stop switch 630 for shooting, and a display 640. The display 640 is configured of the display device 1.

Application Example 5

FIGS. 24A to 24G show appearance of a mobile phone using the display device 1. For example, the mobile phone is assembled by connecting an upper housing 710 to a lower housing 720 by a hinge 730, and has a display 740, a sub display 750, a picture light 760, and a camera 770. The display 740 or the sub display 750 is configured of the display device 1.

The present application contains subject matter related to that disclosed in Japanese Priority Patent Application JP 2009-295331 filed in the Japanese Patent Office on Dec. 25, 2009 and Japanese Priority Patent Application JP 2010-005084 filed in the Japanese Patent Office on Jan. 13, 2010, the entire contents of which is hereby incorporated by references.

It should be understood by those skilled in the art that various modifications, combinations, sub-combinations and alternations may occur depending on design requirements and other factors insofar as they are within the scope of the appended claims or the equivalents thereof.

What is claimed is:

1. A display device comprising:

a plurality of pixels, each pixel having a plurality of individual-color sub-pixels, each sub-pixel including an individual-color light emitting element and having an emission period corresponding to luminous efficiency of the individual-color light emitting element; and a plurality of emission control lines connected to the pixels, wherein, in each pixel, one emission control line among the plurality of emission control lines is connected in common to at least two of the plurality of individual-color sub-pixels, and an emission-control-line drive circuit controls control pulses of the plurality of the emission control lines such that each of the control pulses has a period comprising a plurality of sub-periods, in which both a first emission control transistor and a second emission control transistor are set to be on during respective first and second sub-periods of the plurality of sub-periods and are set to be off concurrently during a third sub-period of the plurality of sub-periods, wherein at least two different individual-color light emitting elements are set to be on concurrently during the first sub-period.

2. The display device according to claim 1 wherein, the emission-control-line drive circuit is configured to apply control pulses to the emission control lines for each sub-pixel to control an on/off state of the emission control transistor of the respective individual-color light emitting element.

3. The display device according to claim 1, wherein the first emission control transistor is an n-type transistor, and the second emission control transistor is a p-type transistor.

4. The display device according to claim 3, wherein, in the first individual-color sub-pixel, the first emission control transistor is set to be (a) on for an emission operation during an H (high) period of each of the control pulses, and (b) off for an non-emission operation during an L (low) period of each of the control pulses, and in the second individual-color sub-pixel, the second emission control transistor is set to be (a) on for an emission operation during the L (low) period of each of the control pulses, and (b) off for an non-emission operation during the H (high) period of each of the control pulses.

5. The display device according to claim 4 wherein the emission-control-line drive circuit is configured to apply control pulses to the emission control lines for controlling an on/off state of the emission control transistor of the respective individual-color light emitting element, and the emission-control-line drive circuit is configured to control (a) length of an emission period of the first individual-color sub-pixel and length of a non-emission period of the second individual-color sub-pixel in accordance with length of the H period of each of the control pulses, and (b) length of a non-emission period of the first individual-color sub-pixel and length of an emission period of the second individual-color sub-pixel in accordance with length of the L period of each of the control pulses.

6. The display device according to claim 5, wherein the emission-control-line drive circuit is configured to control the control pulses such that each of the control pulses has a plurality of H periods and a plurality of L periods within one vertical period.

7. The display device according to claim 5, wherein the emission-control-line drive circuit is configured to adjust the length of the H period and the length of the L period of each of the control pulses such that an individual-color sub-pixel having a first individual-color light emitting element having a relatively high luminous efficiency is short in emission period compared with an individual-color sub-pixel having a second individual-color light emitting element having a relatively low luminous efficiency with respect to the first individual-color light emitting element.

8. The display device according to claim 1, wherein in each pixel, the one emission control line is connected in common to all individual-color sub-pixels.

9. The display device according to claim 8, wherein individual-color sub-pixels having individual-color light emitting elements having relatively similar values of luminous efficiency are set together as the first or second individual-color sub-pixel.

10. The display device according to claim 8, wherein individual-color sub-pixels having relatively similar values of luminosity factors specific to respective colors are set together as the first or second individual-color sub-pixel.

11. The display device according to claim 1, wherein one or more emission control lines are connected in common to, a first individual-color sub-pixel on a first horizontal line, on which only the first individual-color sub-pixel is selectively provided in each pixel, and a second individual-color sub-pixel on a second horizontal line, on which only the second individual-color sub-pixel is selectively provided in each pixel.

12. The display device according to claim 1, wherein each pixel is configured of three individual-color sub-pixels corresponding to three colors of red (R), green (G) and blue (B).

13. The display device according to claim 1, wherein each pixel is configured of four individual-color sub-pixels corresponding to four colors of red (R), green (G), blue (B) and white (W).

14. A light emitting apparatus comprising:

a plurality of light emitting devices, each of the light emitting device having a plurality of individual-color emitting devices, each of the individual-color emitting devices including an individual-color light emitting element and having an emission period corresponding to luminous efficiency of the individual-color light emitting element; and a plurality of emission control lines connected to the light emitting devices, wherein, in each light emitting device, one emission control line among the plurality of emission control lines is connected in common to at least two of the plurality of individual-color emitting devices, and an emission-control-line drive circuit configured to control control pulses of the plurality of the emission control lines such that each of the control pulses has a period comprising a plurality of sub-periods, in which both a first emission control transistor and a second emission control transistor are set to be on during respective first and second sub-periods of the plurality of sub-periods and are set to be off concurrently during a third sub-period of the plurality of sub-periods, wherein, at least two different individual-color light emitting elements are set to be on concurrently during the first sub-period.

15. The display device according to claim 14 wherein the emission-control-line drive circuit is configured to apply control pulses to the plurality of emission control lines for controlling emission operation and non-emission operation of the individual-color light emitting element, and a length of an emission period and a length of a non-emission period of each of the plurality of individual-color sub-pixels are controlled in correspondence to width of each of the control pulses.

16. The display device according to claim 15, wherein the emission-control-line drive circuit is configured to adjust a width of each control pulse applied to the emission control lines such that an emission period of a first individual-color sub-pixel, being set to be relatively long in emission period, is provided during and before or after the whole emission period of a second individual-color sub-pixel being set to be relatively short in emission period with respect to the first individual-color sub-pixel.

17. The display device according to claim 16, wherein the emission period of the second individual-color sub-pixel is divided into multiple periods separated from one another.

18. The display device according to claim 14 further comprising, in each pixel:

a scan line connected in common to the plurality of individual-color sub-pixels, a plurality of signal lines for individual colors individually connected to the plurality of individual-color sub-pixels, a scan line drive circuit configured to apply selection pulses to the scan line for sequentially selecting the plurality of pixels, and a signal line drive circuit configured to individually apply video signal voltages for individual colors to the plurality of signal lines for individual colors to write a video signal to each of the plurality of individual-color sub-pixels in a pixel selected by the scan line drive circuit.

* * * * *